US008618404B2

(12) United States Patent
O'Dwyer

(10) Patent No.: US 8,618,404 B2
(45) Date of Patent: Dec. 31, 2013

(54) FILE CREATION PROCESS, FILE FORMAT AND FILE PLAYBACK APPARATUS ENABLING ADVANCED AUDIO INTERACTION AND COLLABORATION CAPABILITIES

(76) Inventor: Sean Patrick O'Dwyer, Forest Lake (AU)

( * ) Notice: Subject to any disclaimer, the term of this patent is extended or adjusted under 35 U.S.C. 154(b) by 714 days.

(21) Appl. No.: 12/532,013

(22) PCT Filed: Mar. 18, 2008

(86) PCT No.: PCT/AU2008/000383

§ 371 (c)(1),
(2), (4) Date: Sep. 18, 2009

(87) PCT Pub. No.: WO2008/113120

PCT Pub. Date: Sep. 25, 2008

(65) Prior Publication Data

US 2010/0132536 A1 Jun. 3, 2010

(30) Foreign Application Priority Data

Mar. 18, 2007 (AU) ..... 2007901363

(51) Int. Cl.
*G10H 3/00* (2006.01)

(52) U.S. Cl.
USPC ..... 84/645; 84/603

(58) Field of Classification Search
USPC ..... 84/600–603, 645
See application file for complete search history.

(56) References Cited

U.S. PATENT DOCUMENTS

| | | | | |
|---|---|---|---|---|
| 5,300,725 | A | 4/1994 | Manabe | |
| 5,773,742 | A * | 6/1998 | Eventoff et al. | 84/609 |
| 5,962,802 | A * | 10/1999 | Iizuka | 84/609 |
| 6,140,568 | A * | 10/2000 | Kohler | 84/616 |
| 6,225,546 | B1 * | 5/2001 | Kraft et al. | 84/609 |
| 6,307,141 | B1 * | 10/2001 | Laroche et al. | 84/636 |
| 6,313,390 | B1 * | 11/2001 | Adriaans et al. | 84/645 |
| 6,639,142 | B2 | 10/2003 | Takahashi | |
| 6,995,310 | B1 * | 2/2006 | Knapp et al. | 84/722 |
| 7,223,913 | B2 * | 5/2007 | Knapp et al. | 84/722 |
| 7,268,287 | B2 * | 9/2007 | Kawashima | 84/600 |
| 7,314,994 | B2 * | 1/2008 | Hull et al. | 84/645 |
| 7,446,253 | B2 * | 11/2008 | Knapp et al. | 84/722 |
| 7,525,036 | B2 * | 4/2009 | Shotwell et al. | 84/611 |
| 7,589,727 | B2 * | 9/2009 | Haeker | 345/440 |
| 7,612,278 | B2 * | 11/2009 | Sitrick et al. | 84/609 |

(Continued)

FOREIGN PATENT DOCUMENTS

WO WO-2005104549 11/2005

OTHER PUBLICATIONS

Logic Pro 8. User Manual (2007) pp. 658, 659.*
International Search Report for PCT/AU2008/000383 (4 pages).

(Continued)

*Primary Examiner* — David S. Warren
(74) *Attorney, Agent, or Firm* — Brown Rudnick LLP

(57) ABSTRACT

A file creation process, file format and playback device are provided that enables an interactive and if desired collaborative music playback experience for the user(s) by combining or retrofitting an "original song" with a MIDI time grid, the MIDI score of the song and other data in a synchronized fashion. The invention enables a music interaction platform that requires a small amount of time to learn and very little skill, knowledge or talent to use and is designed to bring "mixing music" to the average person.

15 Claims, 30 Drawing Sheets

(56) References Cited

U.S. PATENT DOCUMENTS

| | | | | |
|---|---|---|---|---|
| 7,723,602 | B2 * | 5/2010 | Beckford | 84/609 |
| 2005/0005760 | A1 * | 1/2005 | Hull et al. | 84/645 |
| 2005/0145099 | A1 | 7/2005 | Lengeling et al. | |
| 2006/0075887 | A1 * | 4/2006 | Shotwell et al. | 84/645 |
| 2006/0107826 | A1 * | 5/2006 | Knapp et al. | 84/724 |
| 2006/0219090 | A1 * | 10/2006 | Komano | 84/622 |
| 2007/0044642 | A1 * | 3/2007 | Schierle | 84/616 |
| 2007/0225831 | A1 * | 9/2007 | Sakurada | 700/17 |
| 2007/0256551 | A1 * | 11/2007 | Knapp et al. | 84/722 |
| 2008/0271592 | A1 * | 11/2008 | Beckford | 84/645 |
| 2011/0166679 | A1 * | 7/2011 | Foust et al. | 700/94 |

OTHER PUBLICATIONS

International Report on Patentability for PCT/AU2008/000383 (10 pages).

* cited by examiner

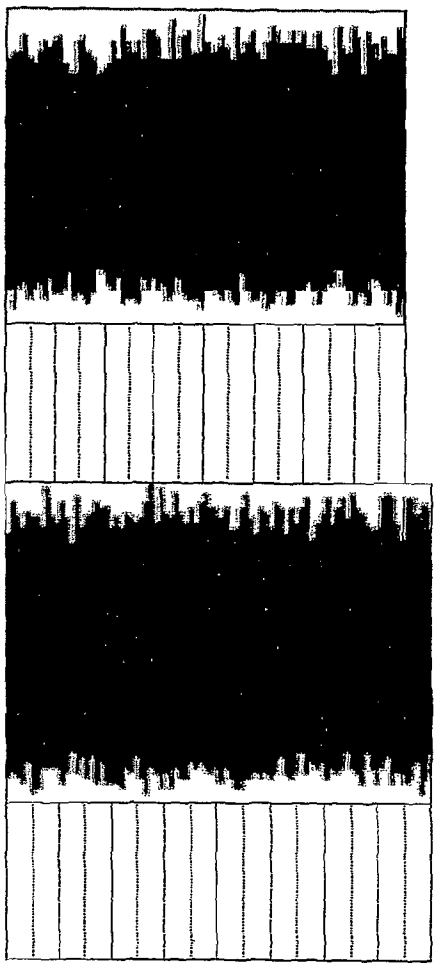
FIG 7
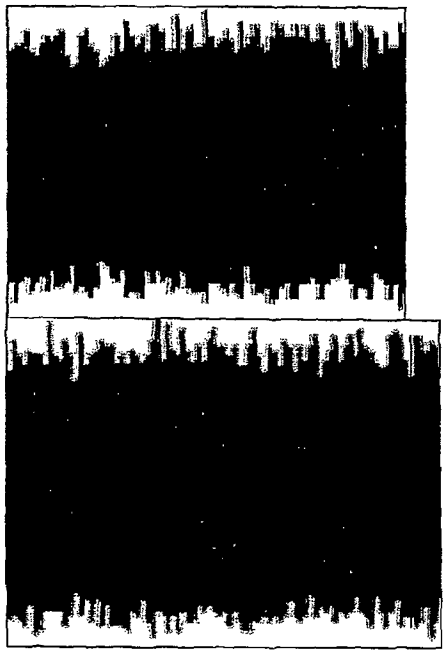

FILE CREATION PROCESS, FILE FORMAT AND FILE PLAYBACK APPARATUS ENABLING ADVANCED AUDIO INTERACTION AND COLLABORATION CAPABILITIES

CROSS-REFERENCE TO RELATED CASES

This is a national stage submission under 35 U.S.C. Section 371 which is based on and claims priority to and the benefit of International Application Number PCT/AU2008/000383 which itself is based on and claims priority to and the benefit of Australian Patent Application Number 2007901363. International Application Number PCT/AU2008/000383 was filed on Mar. 18, 2008, and it was published as International Publication Number WO2008/113120 A1 on Sep. 25, 2008. Australian Patent Application Number 2007901363 was filed on Mar. 18, 2007. The entirety of these two applications are incorporated herein by reference.

FIELD OF THE INVENTION

The invention relates primarily to an audio file creation process, file formal and playback device that enable an interactive and if desired collaborative music playback experience for the user(s) by combining or 'retrofitting' a particular piece of audio or 'song' with a MIDI time grid, the MIDI score of the song and oilier data in a synchronized fashion.

BACKGROUND OF THE INVENTION

Music creation and manipulation software has advanced a great deal in recent years—it has moved from the realm of the professional in a large scale music production studio to the realm of the average person with a personal computer.

It is apparent to the author however that whilst the capability of a full-fledged music production studio is now available to anyone with a computer, it is still only music professionals such as recording artists and DJ's that typically utilise this software. This seems to the case because whilst such capability is now available to the average person, it requires time and effort to learn it and skill, knowledge and talent in order to use it.

It is apparent to the author that providing an interactive music capability that requires a small amount of time and effort to learn and very little, knowledge or talent to use but produces professional results, is desirable. Such capability may bring music interaction into the realm of regular use by the average person.

TERMINOLOGY

MIDI:

As computer aided music production has proliferated so has the use of the 'Musical Instrument Digital Interlace' or MIDI. MIDI has three important functions:

1. MIDI, as its name implies, is an interface between musical instruments and computers.
2. MIDI is a music production format. Of primary importance for this function, MIDI is a digital representation of 'musical score.' MIDI musical score is typically represented as a piano roll (pitch) on the y axes and lime on the x axis. In this fashion musical score can be represented as a plurality of dashes of different lengths (of time) at different pitches. Typically MIDI not only includes data comprising the musical score of a particular song but also other data such as tempo information, parameter levels, parameter changes overtime, synthesis information etc.
3. MIDI is a 'non-waveform' music playback format, a formal whereby a 'MIDI player' uses the instructions to make the music to recreate the music, rather than playing back the original recorded audio waveform (the 'mastered audio') of a song. Obviously the recreated audio will not match the original waveform song however MIDI can be used in this fashion to recreate a 'likeness' of a song, [A song as a waveform data file is large in size in comparison to a MIDI file which is only the instructions to recreate the song.]

Digital Audio/Waveform Data:

Digital audio is typically stored in a digital file as a set of x,y samples representing a waveform. Typically a song that might be sold on an optical storage medium (such as a CD) or downloaded from an Internet music retailer such as iTunes for example is only available as waveform data and a small amount of metadata. An MP3 file for example primarily consists of waveform data along with basic metadata such as the artists name, the song title, music genre etc appended to the waveform data. Such a song (essentially comprising only waveform data) will hereafter be referred to as a 'waveform song.'

['Songs' arc typically available as digital audio (waveform data) and sometimes as musical score in digital format such as MIDI data. The two formats however are generally not designed to 'go together' and if for example you obtained the audio of a rock and roll song and the MIDI for the same rock and roll song and played them back together by matching start points appropriately, the two will generally not match each other properly in terms of overall tempo, individual note timings and sometimes even arrangement (verse/chorus positions etc).]

DISCUSSION OF THE PRIOR ART

Audio Waveform Tempo Changing Software:

Software/hardware is now available and in common use which can detect the tempo of a particular piece of audio or 'song,' and 'time stretch' the song to a user-defined tempo whilst altering the audio such that it does not appear 'pitch-shifted.' Software which enables tempo change without subsequent pitch shift requires several technologies/items of functionality:

1. Waveform analysis software. The ability to accurately detect the tempo of a particular piece of audio or song. This is typically achieved via the detection of 'transients' and other 'interesting' pieces of the waveform of a song. Transients are pieces of a waveform that are of higher amplitude than the rest of the song. Transients can typically be associated with the various drum sounds in a song. It is by analyzing transients and other interesting features of a waveform a software algorithm can detect the tempo of a particular song. Such software is generally quite accurate but due to the human nature of music amongst other factors, it is not always right, and corrections are often required by the user.
2. Time compression and expansion algorithms (TCEAs). Digital transformation of the x,y data points of the waveform such that the tempo of a particular piece of music or song can be altered whilst avoiding the proportionate pitch-shift. This requires complex mathematical transformations and has only recently become a common feature of mainstream music manipulation software.

There are several software packages (or pieces of software packages) currently available which utilize this technology. None of them however has managed to break the mold and into the realm of regular use by the average person. Examples of such programs (or pieces of programs) include:

Ableton Live. Ableton Live provides a user with both waveform analysis software and TCEAs. Making a mix that sounds good however is still a time consuming process that takes skill, knowledge and talent.

'ACID' and 'Apple loops.' Both of these pieces of software provide a user with a pool of purpose specific and professionally made loops which a person can mix together to make their own musical creation. Both of these programs are quite sophisticated and take significant time and effort to learn as well as requiring skill, knowledge and talent to use properly.

Ableton Live:

The main problem with this type of software is that although two waveform songs can be automatically tempo-matched via transient detection they are not automatically 'position-matched.' Using such software two songs can be analyzed and played back together in the same tempo, however the songs will not necessary match each other in terms of bars and beats timing. This means for example that if a user chooses the beginning of a particular bar of the first song to play from, the mix may begin playing from the middle of a bar of the second song. The songs are in the same tempo; however the 'time grid' behind the two different songs is not synchronized. Songs therefore need to be position corrected via input from the user of the software (a process commonly known as 'nudging the song left and right') in order that two songs are position-matched and their bars and beats line up appropriately. This still does not ensure however that the songs will remain position matched throughout and certainly does not mean that the songs will match each other in terms of 'arrangement' (for example the chorus beginning of one song will not necessarily line up with the chorus beginning of another song).

Apple/ACID Loops:

The utilization of 'loops' (bars or bar multiple 'bits' of audio) means that a user does not have to position songs as to one another, bar by bar. There are currently 2 available methods of providing loops to avoid this problem Apple's Logic Pro has them both:

1. Software which gives a user purpose made loops to make songs out of.
2. Software which enables a user to cut up songs into their own loops.

1. Software which gives a user purpose made loops:

Logic Pro enables a user to utilize pre-made purpose specific audio loops. By purpose specific it is meant that these loops are not loops from actual songs, but instead are created solely for the purpose of being an 'Apple Loop'—'Apple Loops' enable a user to create their own musical creations with a reduced level of musical skill and talent. This makes the software more attractive to the average non-musical person. A user does however have to learn to use the software which is of course, quite in depth and sophisticated.

These loops are made using waveform analysis software to detect transients and essentially contain the following data (as per Logic Pro 8 instruction manual) not intended to be exclusive:

Waveform data.

Metadata.

Transient markers.

A common MP3 file has waveform and metadata. By providing the additional transient markers in a file the means is provided by which a TCEA can be used in order that two loops of different tempos can be played back at the same tempo without altering the pitch of either loop.

2. Software which enables a user to cut up songs into their own loops.

This is simply giving the user the means to make their own loops themselves. This is a time consuming and complex process and one that seems destined to only appeal to experienced and proficient users of the various software platforms.

None of the prior art or currently available software provides the functionality or meets the objects of the current invention.

OBJECT OF THE INVENTION

The broad object of the invention is to provide means for music playback to change from being a one-way, static environment (like television) into on interactive, dynamic and sometimes collaborative entertainment experience (like a computer game) and to change the way the music industry operates as a result. It is an object of this invention to have people start to think of regular media players as interactive as opposed to static interfaces.

A further broad object of this invention is to make music interaction a regular activity for the average person. A key element in achieving this is providing the means to such interaction on a platform a user has with them most of the time, and carries around with them almost everywhere—such as the iPhone. The file format of this invention provides for music interaction functionality that is simple enough to use from a handheld device whilst powerful enough to provide professional results.

More specific objects of the invention arc to (this list is not exclusive):

Provide the capability for any two bars from any two waveform songs to be mixed in both tempo and bar by bar synchronization in a non-linear drag and drop fashion (almost instantaneously) whilst requiring very little skill or knowledge from the user.

Provide means for a user to interact with one or more original audio works such as by reordering song arrangements, looping sections by bar multiples, adding further audio via provided MIDI/waveform) data etc and manipulating parameters of the synthesizers used to create the additional audio, mixing together two different parts of the same or different songs, adjusting parameters (filters/effects/EQ), adjusting the tempo of the song; the means of such interaction not being dependent on the recreation of the song from its component parts.

Provide means for users to collaboratively interact with one or more original audio works in similar fashion.

Provide means for users to share their remixes and collaborations with other users such us in an online user community without breaching copyright in any way.

SUMMARY OF THE INVENTION

The invention in its most basic form is an audio file creation process, file formal and playback device that are designed to provide an interactive and if desired collaborative music playback experience for users by combining or 'retrofitting' an audio 'waveform song' with a MIDI time grid and the musical score of the song and other data (such as in the form of MIDI and other data).

The premiere functionality the file format of this invention provides is the capability for any two bars, multiples of bars or pre-designated 'parts' from any two waveform songs to be mixed in both tempo and bar by bar synchronization in a non-linear drag and drop fashion (almost instantaneously) whilst requiring very little skill or knowledge from the user.

In order to achieve this with two bars of audio from different original waveform songs using the most sophisticated software currently available is a time consuming and complicated process.

The current invention provides this functionality via the following summarized list of steps (not exhaustive or exclusive):

File Creation:

Append a MIDI time grid to a waveform song.

Append the MIDI score of the waveform song to the MIDI time grid.

Append markers to the MIDI time grid designating rendition and track parts.

Playback:

Determine mix tempo:

Conform appended MIDI time grids to a uniform MIDI time grid at mix tempo.

Use TCEAs to compress and expand the audio of each bar to the uniform MIDI time grid at mix tempo.

ASPECTS OF THE INVENTION

1. In one aspect the invention resides in a file format that 'retrofits' already produced waveform songs with primarily MIDI (or a proprietary music encoding formal) but also synthesis and playback data (when desired) in order to provide the vehicle for the interactive music playback experience contemplated by this invention. File extensions could include for example .igr, .igv and .igt. The file formal is designed such that all current 'players' can utilize the audio within each file. E.g. a current iPod could play the MP3 audio portion of the file and unknowingly disregard the rest of the file.

2. In a further aspect the invention resides in an online sales repository of songs in said file formal whereby users can download said songs for a cost, in similar fashion to iTunes. Users would typically download said songs onto a portable audio device such as an iPod. The online sales repository would also be intended to host an online user community.

3. In a still further aspect the invention resides in a playback device or devices designed to implement the functionality provided by the file format.

4. In a still further aspect the invention resides in an interactive collaboration device. Users can collaborate locally or online.

5. In a still further aspect the invention resides in an audio waveform manipulation device.

6. In a still further aspect the invention resides in an enhancement to the file formal of the first aspect whereby a playback device is equipped with the separated master tracks of the original recording. This would require record companies to distribute said master tracks.

7. In a still further aspect the invention resides in a file sharing capability. An online user community could be established whereby users can share iGruuv files without breaching copyright as iGruuv files are simply instructions for manipulating a waveform song and do not necessarily have to include the waveform data itself.

8. In a still further aspect the invention resides in an anti-piracy tool.

LIST OF FIGURES

FIG. 1 shows an example process of how to create a file of the format contemplated by the current invention.

FIG. 2*a* shows a waveform and its corresponding transient positions detected by waveform analysis software.

FIG. 2*b* shows a waveform and bar positions determined via analysis of the transient positions.

FIG. 3*a* shows an example of a waveform that may prove difficult for waveform analysis software to accurately detect bar positions.

FIG. 3*b* shows the waveform of FIG. 3*a* with determined bar positions shown.

FIG. 7 illustrates that the appended MIDI time grid may not be time/length consistent between bars.

DETAILED DESCRIPTION OF THE INVENTION

[The following description uses MIDI as an example of how the current invention could be implemented. The current invention however could be implemented with a proprietary time grid or other timing designation/musical score encoding formal. This could circumvent any copyright issues involved with the use of MIDI particularly if only 'alternative' MIDI tracks are provided rather than MIDI versions of the original tracks and the waveform song is not included (described in detail below).]

1: File format 1.

The file formal described herein (hereafter for convenience referred to as the 'retrofile' file formal) is a file formal formed by the retrofitting of an 'original' waveform song (such as an MP3 file) with MIDI (or other digital music encoding format) and other data (some specific to the file format of this invention) in order to provide the interactive music playback experience contemplated by this invention (hereafter called retrofile functionality).

A retrofile in its most basic form is essentially a waveform song (with included metadata such as in an MP3 file) retrofitted with an appended MIDI time grid. The MIDI time grid can then be further appended with the MIDI score of the song. The MIDI time grid must be properly and synchronously appended in order that the MIDI version of the song can be properly overlaid. If the waveform and corresponding MIDI version of the song are properly synchronized with the waveform song, the waveform song can be manipulated by manipulating the MIDI time grid and score and letting the 'audio follow the MIDI.' This means also that a playback device need only 'process' and communicate in MIDI.

Figure 1:
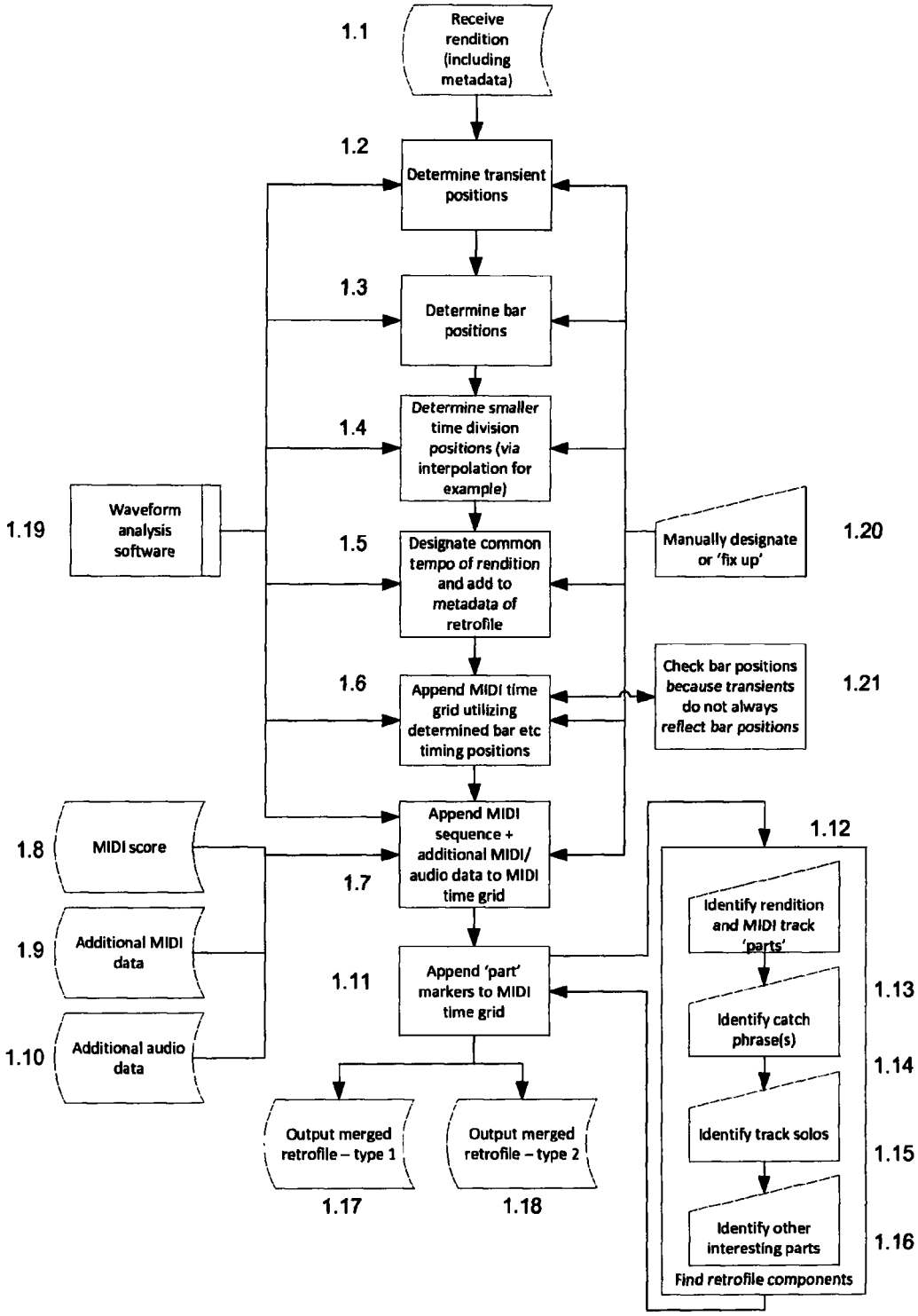

The following is an example of how a retrofile might be constructed:

[The following process is shown in FIG. 1. FIG. 1 should be taken as an example process of how to create a file that will enable retrofile type functionality. A person skilled in the art will recognize that there will be alternative processes leading to file structures that will enable the same functionality. All such structures are taken to lie within the broad ambit of this invention.]

1 . . . Receive an audio rendition such as an MP3 file 1.1. [A retrofile may also include video data.]

Figure 2A:
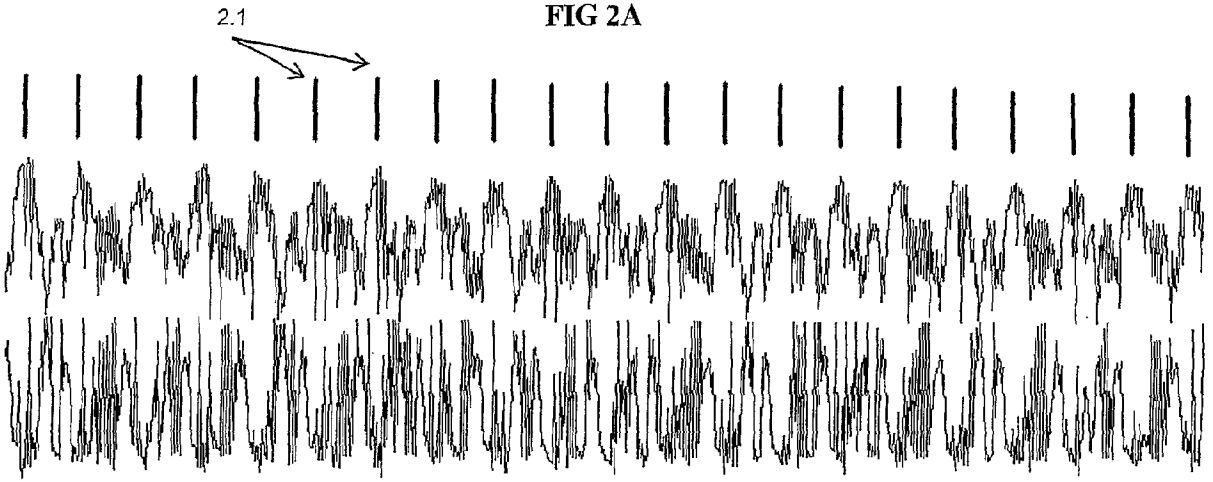

2 . . . Determine transient positions 1.2 Analyze the audio file using waveform analysis software 1.19 to determine the position of transients in the waveform. An example of detected transients utilizing waveform analysis software is shown in FIG. 2*a*. Detected transients 2.1 are shown as vertical bars above the waveform.

Figure 2B:
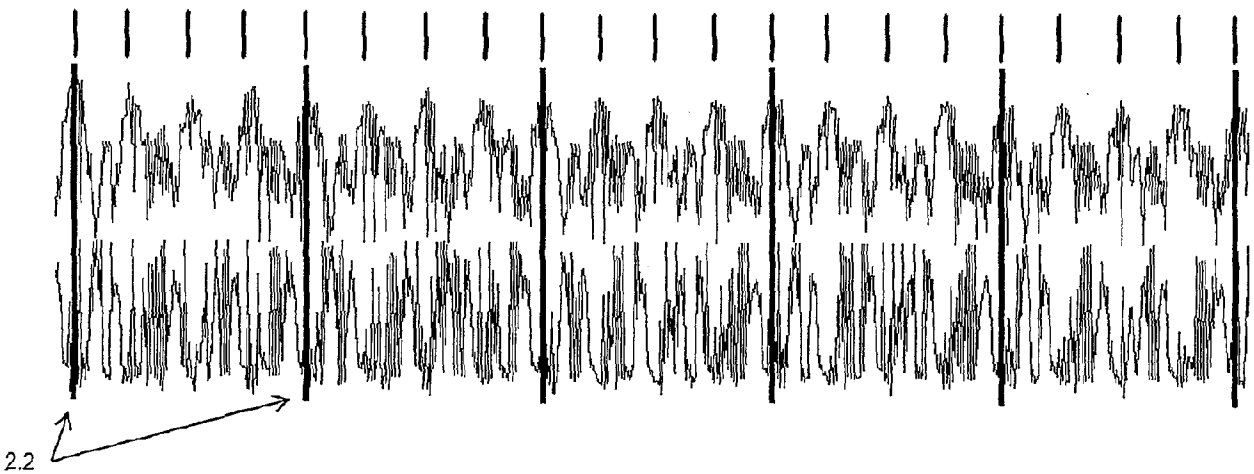

3 . . . Determine bar positions 1.3. Utilize the transient positions to determine the bar start/end positions of the rendition. If the rendition is tempo-consistent as in FIG. 2, this process is easier as one bar position can be found and the rest extrapolated. This process could at the current time largely be undertaken by software. An example of this is shown in FIG. 2*b*. The bar positions 2.2 are fairly easily determined (even by eye) and as soon as the start and end position of one bar has been determined the rest can be extrapolated.

Figure 3A:
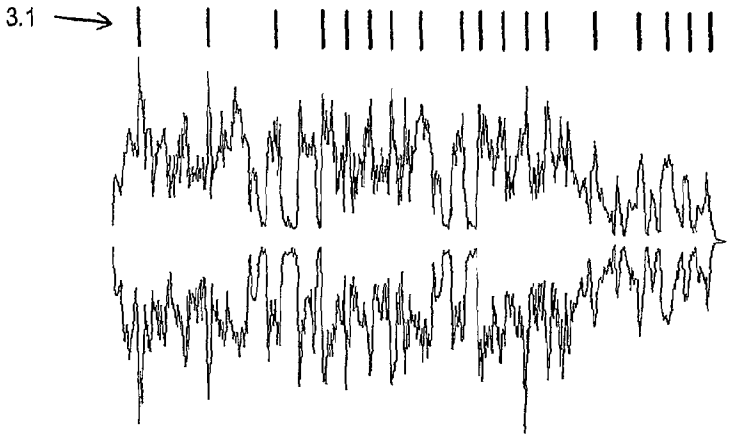
Figure 3B:
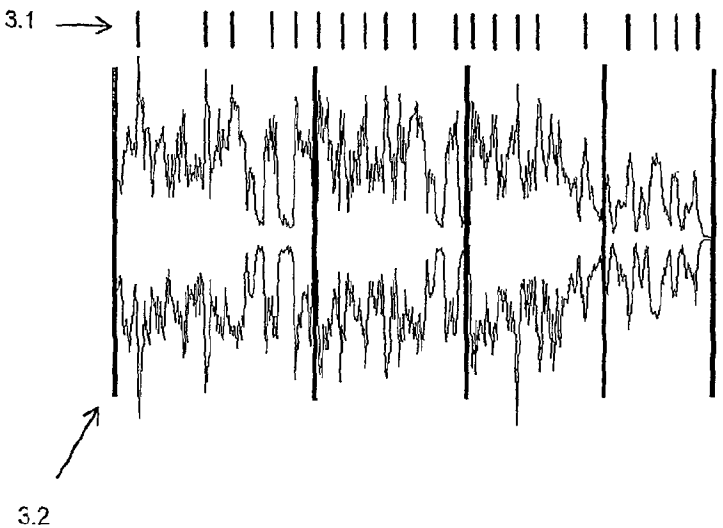

If the rendition is not tempo consistent, has purposeful tempo changes throughout it or the waveform analysis software provides results of little use however, it is likely many bar positions will need to be determined individually and manually 1.20—I.e. with human input as to error correction of software analysis of bar position or human input determining bar position without the aid of waveform analysis software 1.20. An example of a waveform that may prove difficult for waveform analysis software to accurately determine bar positions is shown in FIG. 3. The waveform is shown with transient detected positions in both FIG. 3*a* and FIG. 3*b*. The correct bar positions have been appended as black lines 3.2 in FIG. 3*b*. It is clear from FIG. 3*b* that the bar positions not only do not match the detected transient positions but are not uniform in separation.

Figure 4:
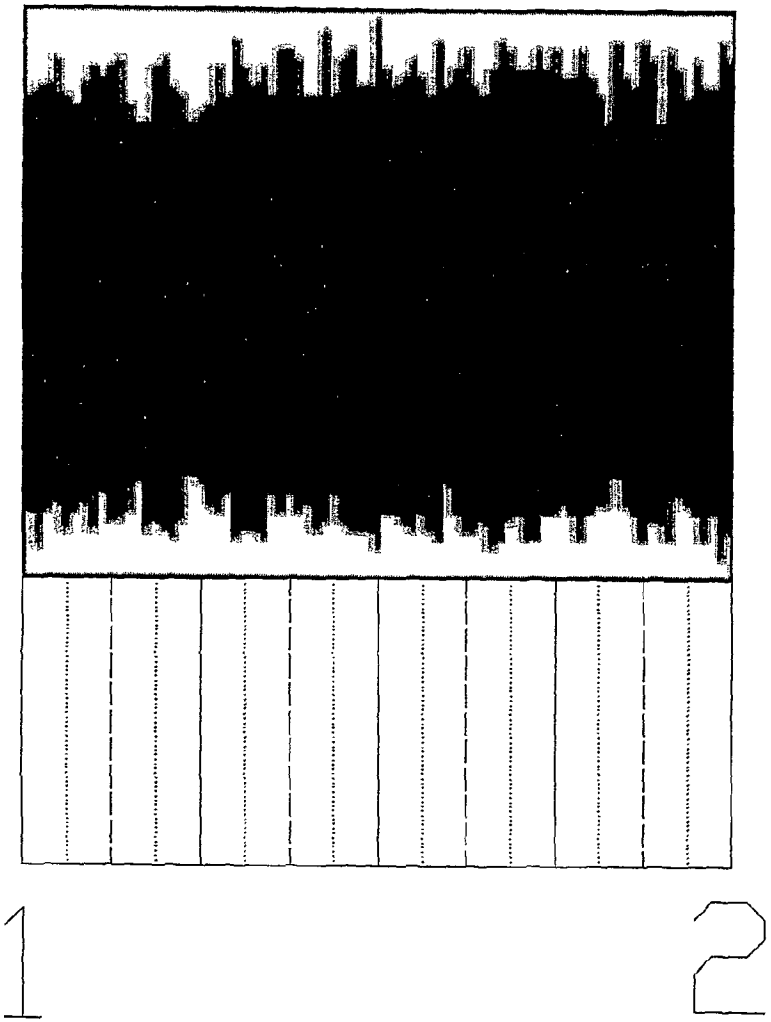
FIG. 4 shows a waveform bar with smaller time grid positions interpolated.

4 . . . Determine the time grid between bar positions—to 1/16's for example 1.4. This process would in the vast majority of cases be as simple as interpolating smaller divisions between bar position determinations (such as 1/16's and 1/64's etc) however in some circumstances the grid may need to be corrected at this fine level manually 1.20 to some degree or via analyzing the results of waveform analysis software 1.19 due to errors in the recording of the original rendition for example. FIG. 4 shows a waveform bar with interpolated divisions to 1/16's once bar positions (1 and 2 in this case) have been determined.

Figure 5:
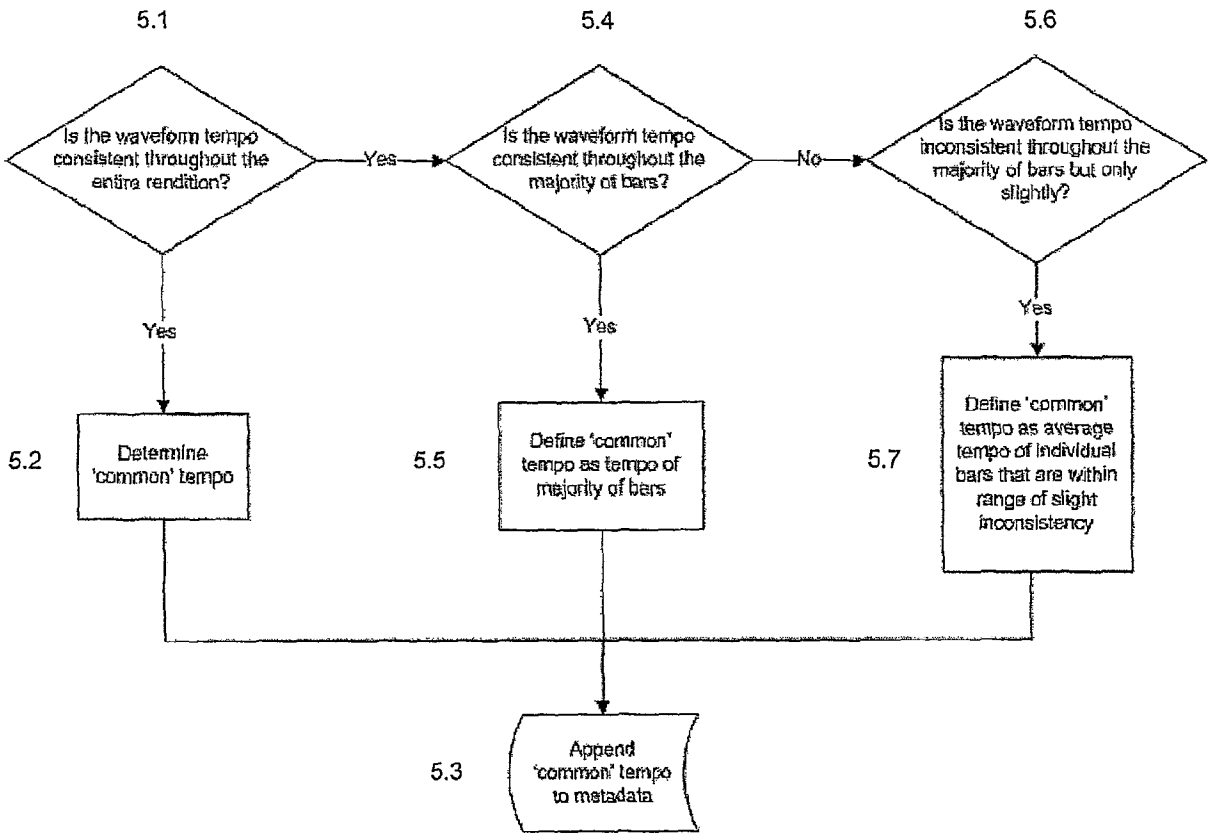
FIG. 5 shows an example process by which the 'common' tempo of a waveform may be designated.

5 . . . Designate a 'common' or average tempo of rendition and add to metadata of retrofile 1.5. This is a tempo derived from the most commonly used and consistent tempo in the waveform file (I.e. some songs may have a tempo change somewhere in them but are otherwise consistent) the 'common' tempo, or the average tempo of a rendition with slightly inconsistent tempo (such as a rock and roll song not recorded in time to a computer for example) is designated as the 'common' tempo. This process is shown in FIG. 5.

If the waveform tempo is consistent throughout the entire rendition 5.1 the common tempo is determined as that particular tempo 5.2 and appended to the metadata 5.3. If the waveform tempo is not consistent throughout the entire rendition 5.1 but is consistent throughout the majority of bars 5.4 (E.g. the song may have a 'break' section where the tempo changes but other than that the tempo is consistent) the common tempo is defined as the tempo of the majority of bars in which the tempo is consistent 5.5 and appended to the metadata 5.3. If the waveform tempo is slightly inconsistent throughout the rendition 5.6 (such as in a rock and roll song not recorded to a metronome) the common tempo is defined as the average tempo of individual bars that are within range of slight inconsistency 5.7 (meaning that such a song may have a 'break' where it departs from the main average tempo and these bars are ignored) and then appended to the metadata 5.3.

The purpose of finding a common tempo and appending it to the metadata of the retrofit file is that upon playback such information can be used by a file search filter, TCEA or collaboration process to determine a likely 'tempo fit' between two songs. It also provides a user with this knowledge for any purpose.

Figure 6:
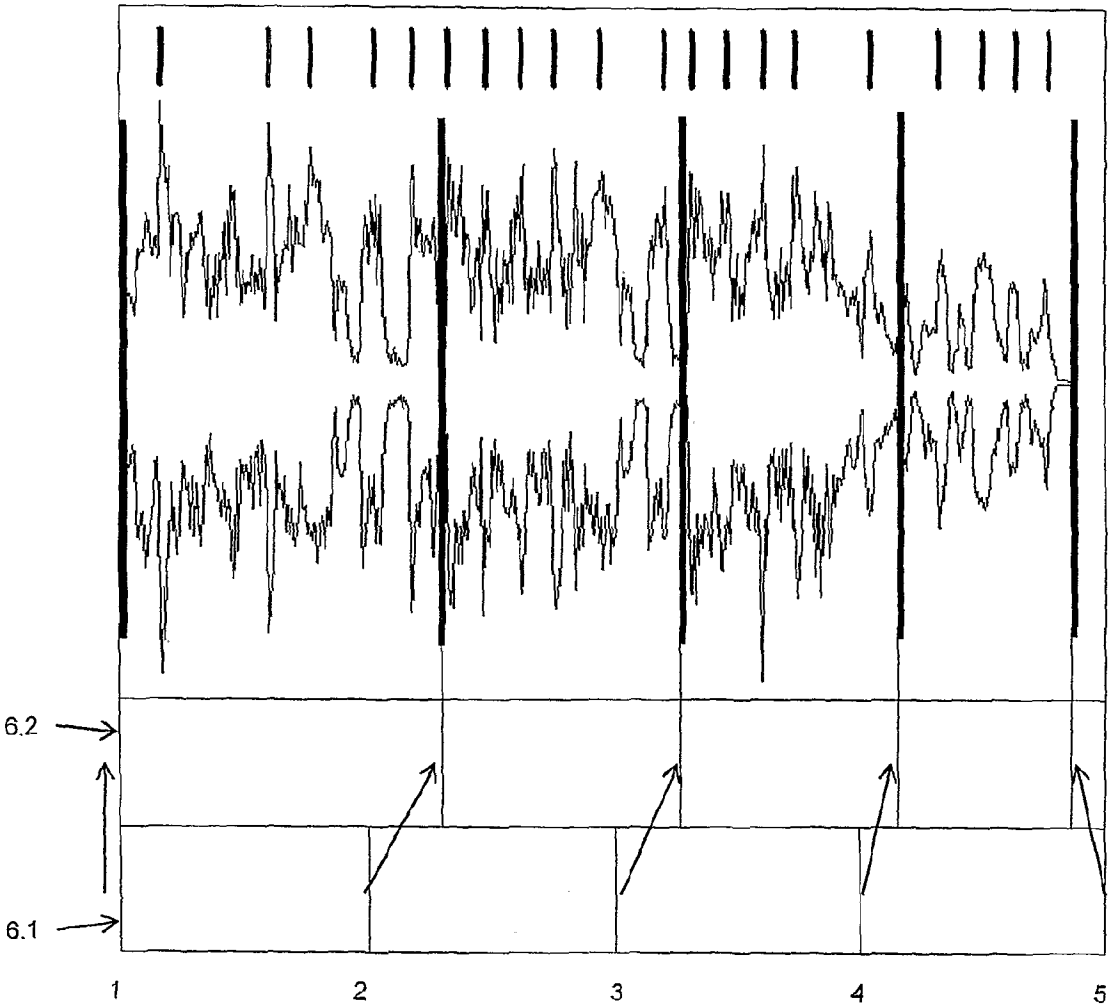
FIG. 6 shows an example of a MIDI time grid being appended to a waveform this is basis of the 'retrofile' format.

6 . . . Append a 'MIDI time grid' to the audio rendition in synchronous fashion 1.6. A MIDI time grid must be accurately mapped onto the waveform. This process entails appending the determined bar positions found using waveform analysis software 1.19 and/or human 1.20 input with MIDI bar positions. An example of this process is shown in FIG. 6. A tempo consistent MIDI timeline would normally have consistent bar lengths like that of 6.1 however when appended to a waveform song with inconsistent bar lengths the bar positions are appended to wherever the particular start/end of the waveform song bar is located and may therefore differ in length like the MIDI bars of 6.2. The process of appending a MIDI time grid also entails appending smaller time divisions such as 1/16's, 1/64's etc. Similarly to the case for MIDI bars appended to the waveform song it may be the case that appended smaller time divisions such as 1/16's are of differing lengths.

Figure 8:
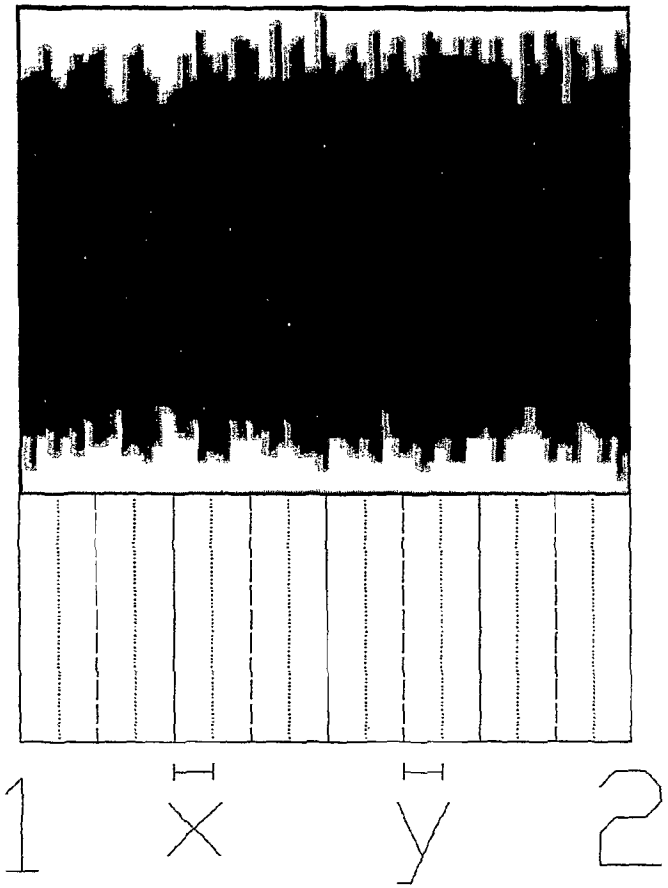
FIG. 8 illustrates that the appended MIDI time grid may not be time/length consistent between smaller time divisions than bars.

In a retrofile, MIDI data is appended to the waveform song to match the time elements of the waveform song regardless of the placement of these events as to 'true' time. It must be the case that MIDI bar 21 (for example) starts at exactly the same moment as waveform song bar 21. Two bars of a particular waveform song may be of slightly different tempos and therefore play for slightly different amounts of time, however when appended with a MIDI time grid both bars are appended with 1 bar of MIDI time. This is illustrated in FIG. 7. This type of MIDI time grid matching must occur on all scales—from the arrangement timing level right through to bars, beats, 1/16's and 1/64's etc and may require human input 1.20 as well as computer analysis 1.19. FIG. 8 illustrates MIDI time grid matching such as in FIG. 6 at the small scale and shows 1 bar of a waveform song appended with MIDI. Two 'lengths' of waveform song time are shown; x and y. Both x and y are 1/16's of a bar. Although both x and y are 1/16's in terms of the timing of the waveform song, they are not actually the same length of true time (I.e. one 1/16 of the waveform is slightly longer or shorter than the other). The appended MIDI must take this account, and exactly match the waveform song; therefore MIDI 1/16's x and y also do not equate to each other in length. This is to make up for variations in the waveform song at the bar/note event level.

It is the case however that tempo inconsistencies at smaller time divisions (such as 1/16's) would be rare and hard to detect by car in any case so in the vast majority of circumstances as long as the MIDI bars are appended to the waveform correctly the smaller MIDI time divisions could simply be interpolated.

If a MIDI time grid is correctly matched/appended to a waveform song, a playback device need only interpret and process the MIDI and the resulting 'audio will follow the MIDI.' If a retrofile is used by a playback device to loop any particular bar, the resulting waveform data (following the looped MIDI) will loop correctly and 'sound right.'

Upon playback, retrofile MIDI bars will be conformed to user or process defined tempos in order to match and mix with other retrofile MIDI bars from the same or different songs. In this case TCEAs will be used to expand or compress the waveform audio so that the MIDI timeline will be uniform and consistent in length and time at every scale (from 1/64's to bars to arrangement sections). It is by making retrofile MIDI bars uniform in time at every scale via TCEAs during playback that it is possible to mix any two bars from any two songs and have them match each other in tempo and bar by bar synchronization and 'sound right.'

Figure 9:
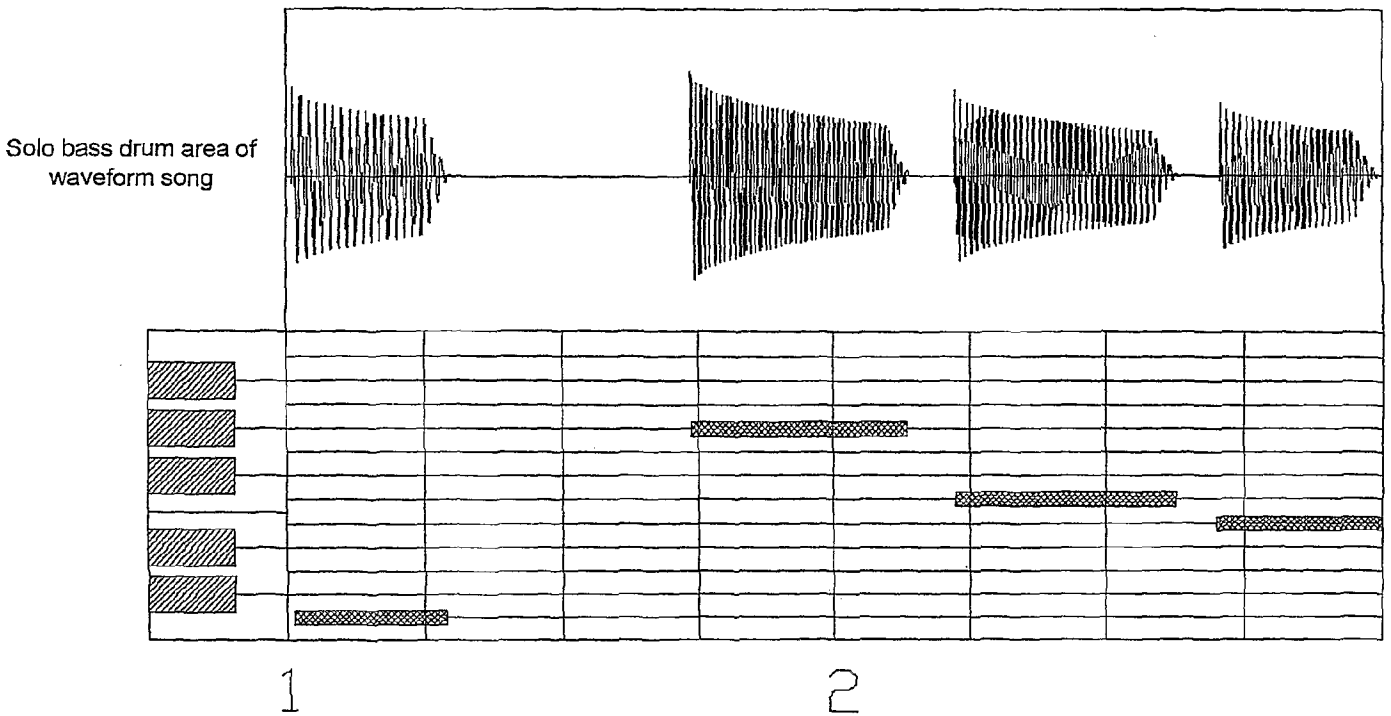
FIG. 9 illustrates that notes or drum sounds may not always fall exactly on the time grid they are played to during creation and thus cannot be relied upon to always accurately determine the position of the bars etc of the appended MIDI time grid.

Normally transient, markers are used by TCEAs etc in order to achieve this. It is preferable for a TCEA to use an appended MIDI time grid rather than transient markers however, as transient markers are not always a true guide to bar start/end positions. This is because it is not always the case that note or drum hit events fall exactly on the time grid they are being played to during creation (and hence upon playback). This is shown in FIG. 9. In fact playing notes or drum hits slightly off the time grid is often referred to as giving the music some 'feel' or 'funk.' Therefore when appending a MIDI time grid to a waveform song it cannot be assumed that events such as notes or drum hits that start a bar fall exactly at the start of a bar on the time grid. Note and drum hit events are a good guide, but cannot be relied upon as being exact. Therefore bar positions should be checked before the MIDI time grid is appended 1.21. This will likely require human input.

7 . . . Append the MIDI score/sequence 1.8 of the original rendition to the appended MIDI time grid in synchronous fashion 1.7. A MIDI version of the waveform song 1.8 must be mapped onto the appended MIDI time grid 1.6. The added MIDI is essentially unchanged; it is only during playback that its timing might be altered due to differences in the timing of the appended MIDI time grid. From this point on, it is only necessary to analyze the appended MIDI time grid and added MIDI score/sequence because during playback the audio simply follows the MIDI. Therefore, in order to designate parts such as verses and choruses, a process only need analyze the appended MIDI time grid and added score/sequence to add MIDI markers designating the beginning and end of verses, choruses etc.

Figure 10:
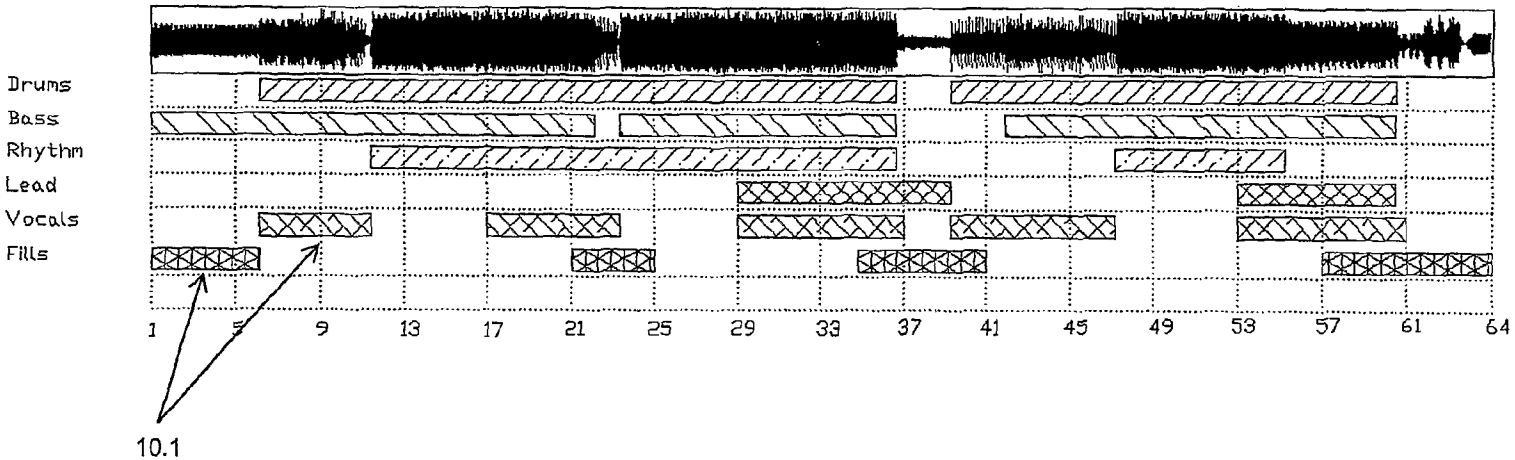
FIG. 10 is a representation of a waveform song retrofitted with the MIDI score of the original song appended to the MIDI time grid.

FIG. 10 is a representation of a waveform song retrofitted with MIDI data. In similar fashion to modern Digital Audio Workstation (DAW) software (such as Apple's Logic Pro) each MIDI track is shown as a horizontal row with track 'parts' contained within each row. Each track contains time vs. pitch or time vs. sample data in a form similar to FIG. 9. The MIDI version of the waveform song need not be limited to note events and can take advantage of all aspects of MIDI such as note velocity and aftertouch, parameter levels over time (for example cutoff frequency and resonance) and playback data such as effect levels over time etc. [MIDI data is in common use in modern sequencing and other software and its form and functionality is not described in detail here.]

It is preferable that the timing of each MIDI event in each MIDI track match its corresponding waveform song event as closely as possible. Again this can be achieved via the aid of computer analysis of a waveform song 1.19 but human input is likely to be required 1.20. As described earlier, in many instances the timing of a musical event does not exactly coincide with the time grid (such as a MIDI time grid) used to describe the timing of the events of the music. Whether by accident or by design it is often the case that musical events do not exactly match these timing increments. Musical score however does not provide this information. Musical score provides information in time increments of the time grid the song is based/constructed in, for example 1/8's and 1/16's for a song in 4-4 timing. A song played back in such fashion (with every note exactly conforming to the time grid) is often described as having no 'feel' and as sounding unnatural and 'computerized.' A retrofile song takes this into account by using both computer analysis 1.19 and when required human input 1.20 in its construction in order that MIDI score events match their waveform song counterparts and not always necessarily conform to the MIDI time grid. The following are some example methods of how this might be achieved (not exclusive):

The MIDI can be created in the first instance by a human playing a keyboard whilst reading the score for example or matching events on a computer screen by eye to get them as close as possible and then adjusting them to match the event timing of the waveform as closely as possible by ear 1.20.

Utilizing waveform analysis software 1.19 to provide positions of individual notes and then fixing them up/adjusting them 1.20 to match the event timing of the waveform as closely as possible by car.

8 . . . Append any alternative synthesis/playback data for original MIDI tracks 1.7/1.9.

A retrofile file could come with pre-arranged example 'play-sets' for MIDI tracks based on the original waveform song as a learning tool and guide as well as a means of interacting with a rendition in a pre-defined fashion. Play-sets could be pre-arranged remixes that a user could first simply playback (filter and effects parameters for example) such that the user could hear how various parameters (such as filter cutoff frequency) effect the playback of particular tracks etc and then manipulate and interact whilst staying within the pre-set guidelines of the 'play-set.'

9 . . . Append any additional/alternative MIDI or waveform tracks and associated MIDI data to the appended MIDI time grid 1.7/1.9/1.10.

It is in this section of the retrofile creation process that additional/alternative MIDI 1.9 or audio 1.10 can also be appended to the MIDI time grid time-wise via marker and added to the file, if so desired.

Figure 11:
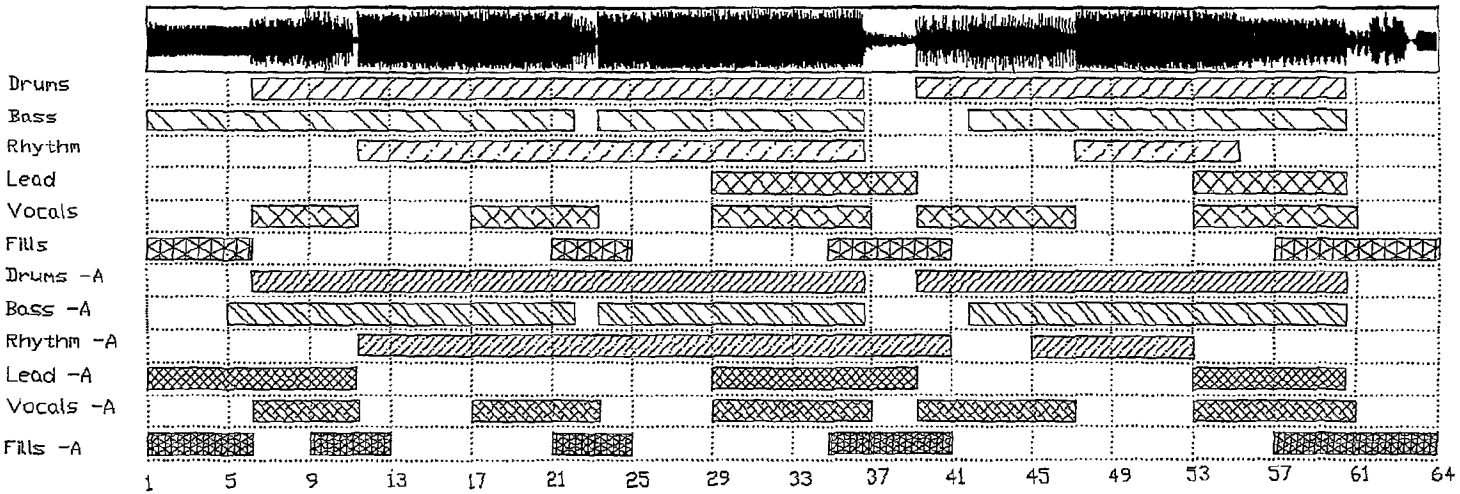
FIG. 11 is a representation of a waveform song retrofitted with alternative MIDI score (and perhaps waveform and other data) appended to the MIDI time grid.

In order to make the user 'feel like a professional DJ' with as little skill, knowledge and talent as possible it may be beneficial to add alternative MIDI tracks (and associated synthesis and playback data etc or waveform samples) or waveform tracks or parts. This is shown in FIG. 11. In this case a user can mix in alternative tracks with the original waveform song such that to another listener it would appear that the user is adding entirely new tracks/parts to the remix and the users input sounds good. [A user could download additional and alternative tracks to retrofiles as updates—described in detail later.] In this fashion the user could output (racks that others would interpret as requiring the skill, knowledge and talent of a professional DJ whilst in fact the user has merely activated a track and indeed has utilized very little skill, knowledge or talent, furthermore the user can interact to a large extent with the additional/alternative (racks creatively whilst still always sounding good (it is virtually impossible to sound bad as the added tracks/samples etc are always in the correct timing, scale, pitch, progression etc). Here the lines between requiring a little to no and a lot of skill, knowledge and talent become blurred because although it is virtually impossible to sound bad, it is possible to use skill, knowledge and talent in a creative fashion to make the additional/alternative or indeed the original tracks or overall rendition sound better.

Figure 12:
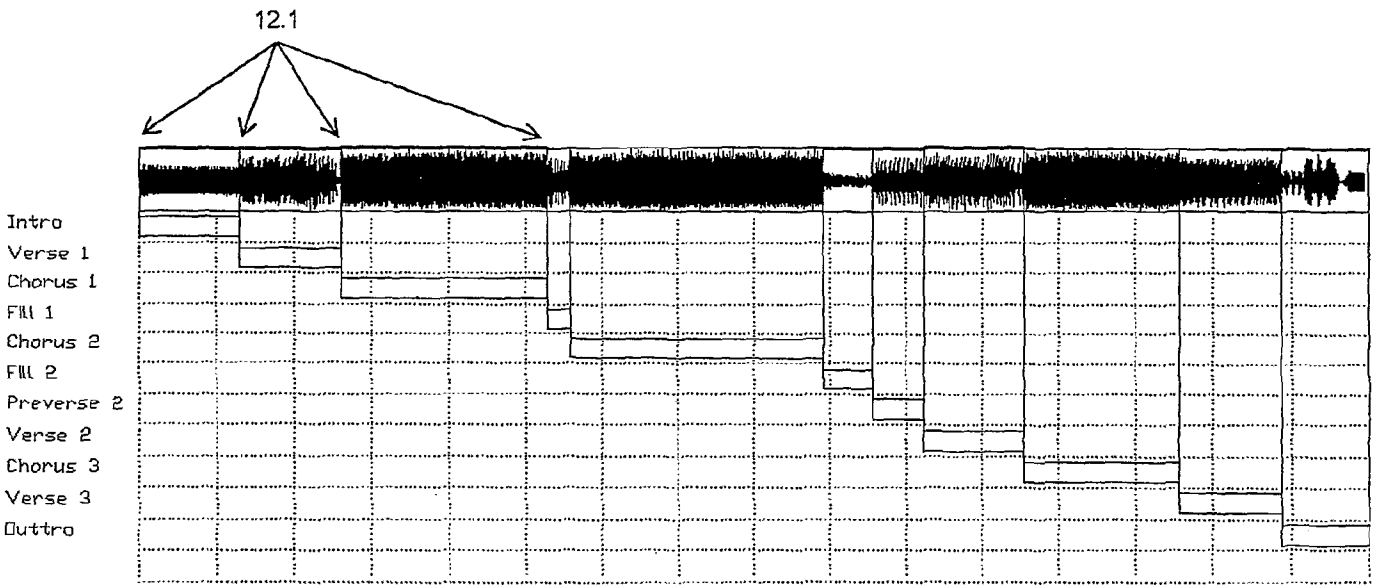
FIG. 12 shows a retrofile broken up into arrangement sections via rendition part markets.

10 . . . Append rendition part markers to the MIDI time grid 1.11/1.13. This is illustrated in FIG. 12. This data would typically be in the form of MIDI time grid start and end position values associated with the rendition sections of a waveform song 12.1. The names of the rendition sections and other metadata describing them (minor/major, key, structural part, genre etc) would also be included in the retrofile for ease of reference and for filtering during part selection for remixing. Part markers and arrangement sections can relate to any part of the waveform song (and Can overlap and be included inside one another) and would certainly include the waveform songs main 'arrangement parts' such as intro, verse 1, chorus 1, break down, verse 2, chorus 2, crescendo and outtro.

Figure 13:
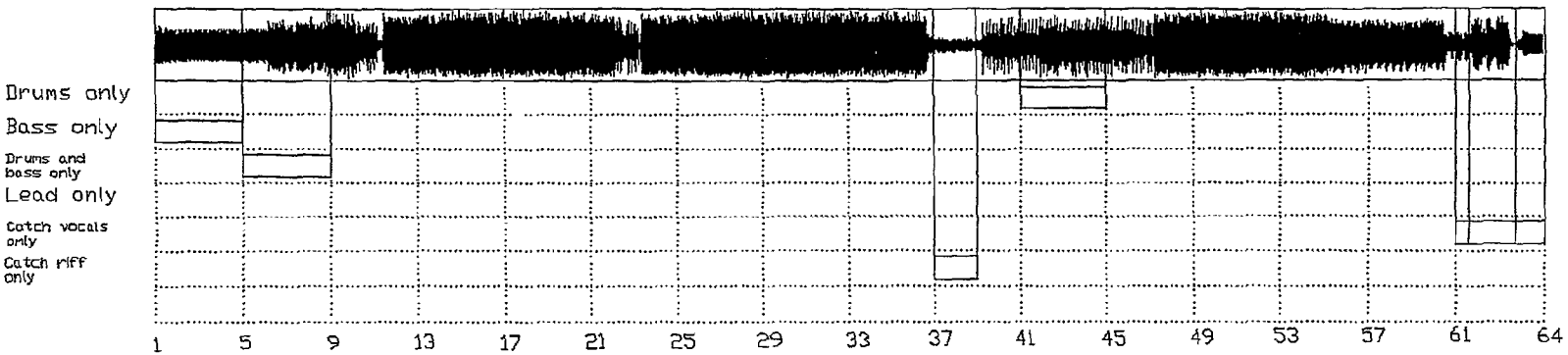
FIG. 13 shows a retrofile broken up into solo sections via rendition part markers.

It is particularly important that track solos are also rendition part marked 1.15. An example of this form of rendition part marking is shown in FIG. 13. In most songs, at some point or another it is only the bass that is playing, or the drums, or the vocal catch phrase etc (or a combination of only 2 tracks etc). If these parts can be isolated and designated as parts they can later be played back together to reform a particular verse, chorus or other song part. I.e. played back together they will sound the same as another part in the rendition when they were actually played together in the original rendition. Having separated and remixed them however gives the end-user the ability to alter/'tweak' one track of the part (say the guitar) without altering the others and therefore give the user the impression of improvising within a 'band,' of 'being in the room' and playing an instrument when the waveform song was originally recorded.

Rendition part markers however could include any part of a song that is considered 'interesting.' For example, there is generally part of a song that most people will hum or sing in order to attempt to let someone else know what song they are thinking of—a catch riff, melody or phrase. These would typically be rendition part marked.

Figure 14:
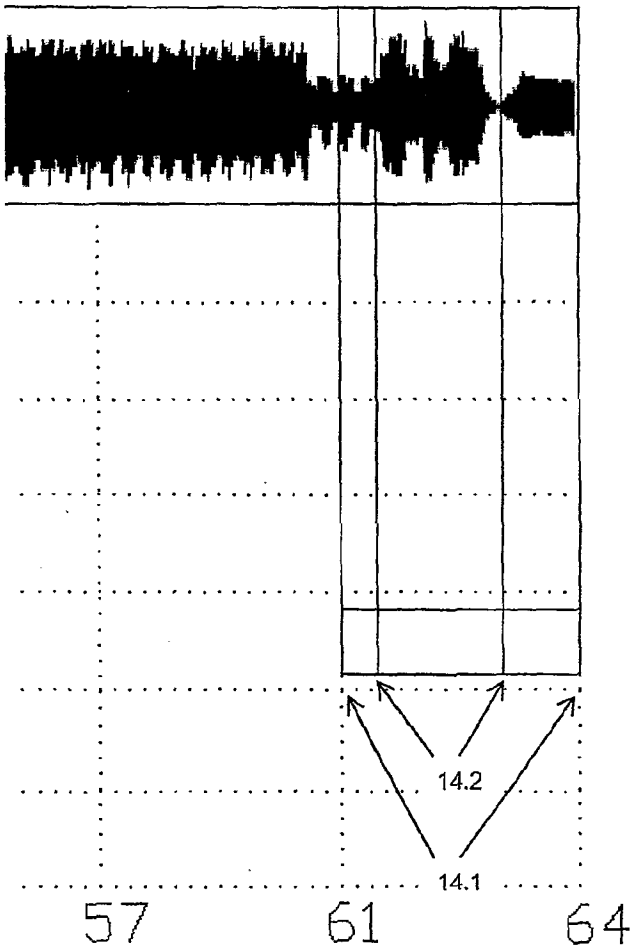
FIG. 14 illustrates that some parts (such as vocals catch phrases) are within bars and need bar markers to define their timing and also markers to define when to start and stop playing waveform data.

Some parts are within bars and need bar markers to define their liming and also markers to define when to start and stop playing the waveform data within their associated bar markers. This is shown in FIG. 14. Vocal catch phrases are a good example of this. A catch phrase 1.14 is always in timing with the bars however typically does not start and end at the beginning and end of a bar but rather somewhere in the middle. In order to meaningfully define a vocals catch phrase (for example) such that it can be played back in synchronized tempo with any other bar of any other song and only that piece of waveform is played two sets of markers are required, one set inside the other. The first set being on the outside, the bar markers so that the catch phrase can be timed with other bars 14.1, and the second set inside the first, denoting when to start and stop playing the waveform inside the particular bar(s) 14.2.

Many part markers however are already in place simply because a MIDI version of the original rendition has been appended to the MIDI time grid appended to the waveform song. As can be seen in FIGS. 10 and 11 many parts could be isolated by a user simply selecting a particular MIDI track part 10.1.

Figure 15:
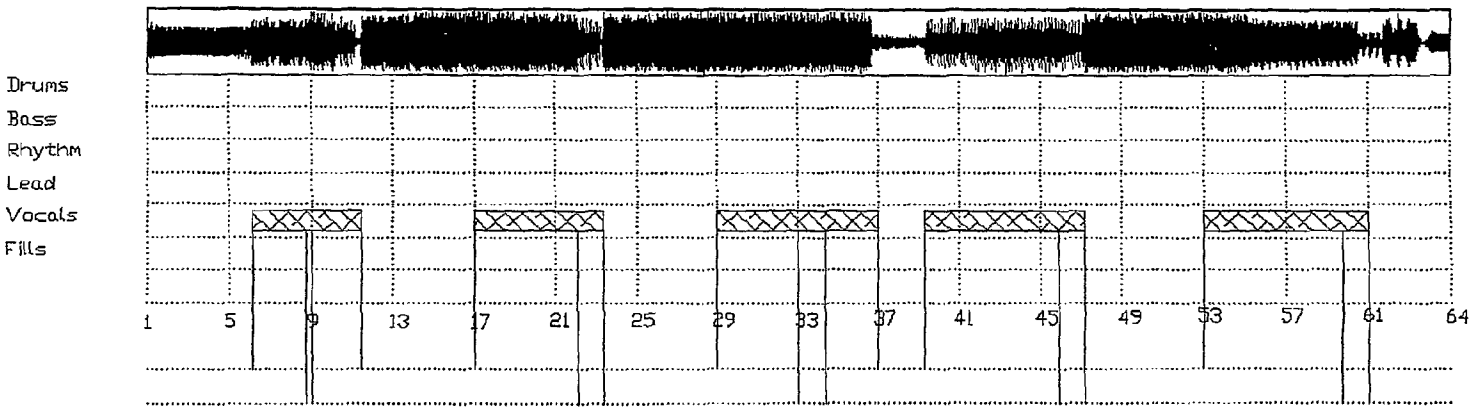
FIG. 15 illustrates that parts could be designated by designating their position inside MIDI tracks.

Furthermore vocals parts or other catch phrases 1.14 could be denoted by denoting their position inside MIDI tracks. This is shown in FIG. 15.

Any other interesting rendition parts could be designated as per the above process 1.16.

Figure 16:
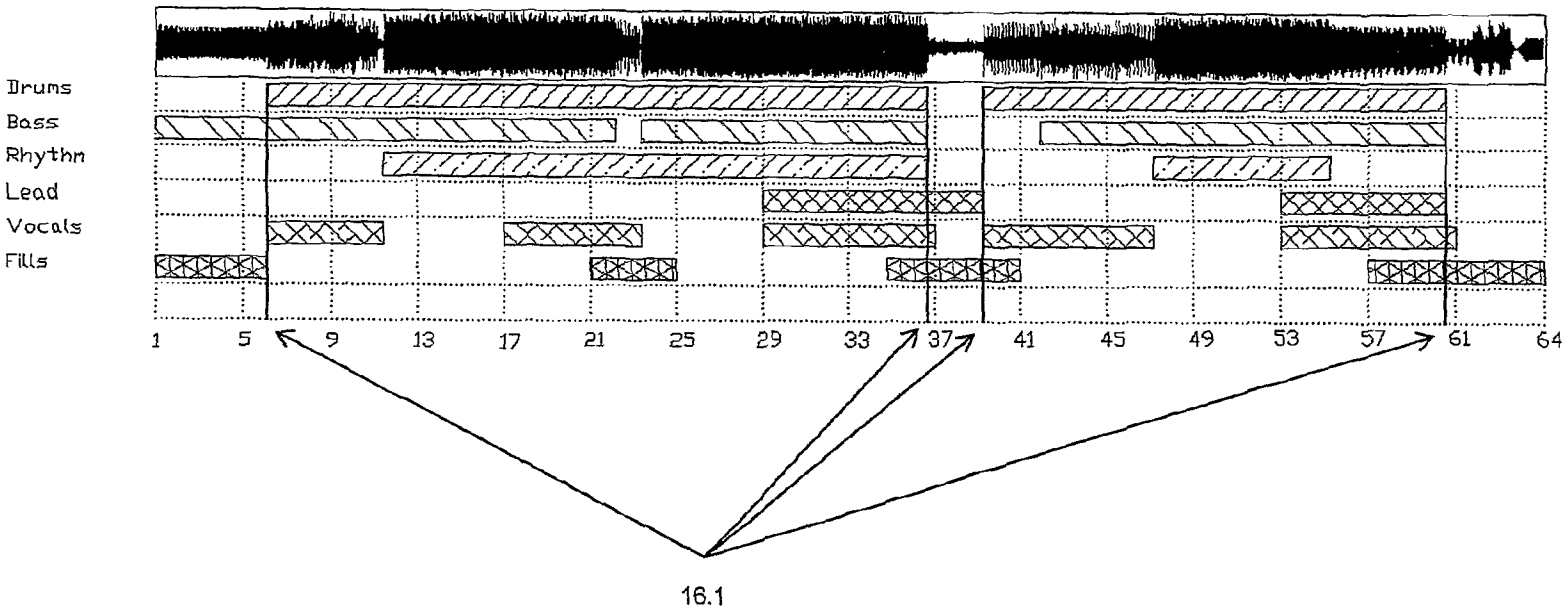
FIG. 16 shows that a retrofile can be broken up into track parts via track part markers.

11 . . . Append track part markers to the MIDI time grid 1.11/1.13. This is the process of finding, designating and appending MIDI time position markers defining parts of all the individual MIDI tracks and added/alternative MIDI/waveform tracks. A track part is essentially defined by whether the track is being played or not at any particular time. MIDI track parts would also have associated metadata in similar fashion to rendition parts. An example of this is shown in FIG. 16 for drum track parts 16.1.

Any other interesting track (MIDI or alternative MIDI or audio) parts could also be designated as per the above process 1.16.

12 . . . Output the file as either a type 1 retrofile or type 2 retrofile. Type 1 retrofiles files contain both the original rendition and the retrofile data. Type 2 retrofiles contain only the retrofile data and a reference marker such that if a user owns both the type 2 retrofile and the associated original waveform rendition, the two files can be synchronized and retrofile functionality can be achieved by using both files either separately or pre-merged by a specific file merge process. The advantage of creating type 2 retrofit files is that the audio/waveform and MIDI/other data are separated; therefore the original waveform rendition copyright is separated from the retrofile data. This is advantageous for the sale and transfer of files both in the retail market and between end users.

[The above example process is representative of a concept and any retrofit of data that enables manipulation/interaction/addition to etc of a waveform song in the manner contemplated by this invention is taken to be within the broad ambit of this invention.]

By way of example a retrofit file therefore contains the following data (not exclusive):

Waveform data (if type 1 retrofit file).

Reference marker to line up MIDI time grid with waveform song (it type 2 retrofit file).

Metadata.

Transient markers.

Common tempo of rendition.

MIDI time grid including bar markers and 1/16 markers etc.

The complete MIDI score of the rendition.

Rendition part markers as MIDI positions. This will include for example—intro, verse 1, chorus 1, break down, verse 2, chorus 2, crescendo, outtro as well as MIDI track part markers.

Alternative MIDI synthesis/playback data, 'Play-sets.'

Additional/alternative MIDI parts or tracks (and possibly associated samples—for MIDI instruments for example) and/or additional/alternative waveform tracks.

Metadata for rendition part markers, MIDI (rack part markers, alternative MIDI synthesis/playback data and for additional/alternative MIDI parts or tracks and/or waveform tracks.

A retrofile will not take up much more memory than its original waveform rendition counterpart (an MP3 file for example) however due to the fact that the additional data in a retrofile (in most cases largely comprising MIDI data) requires comparatively very little storage space.

Figure 17:
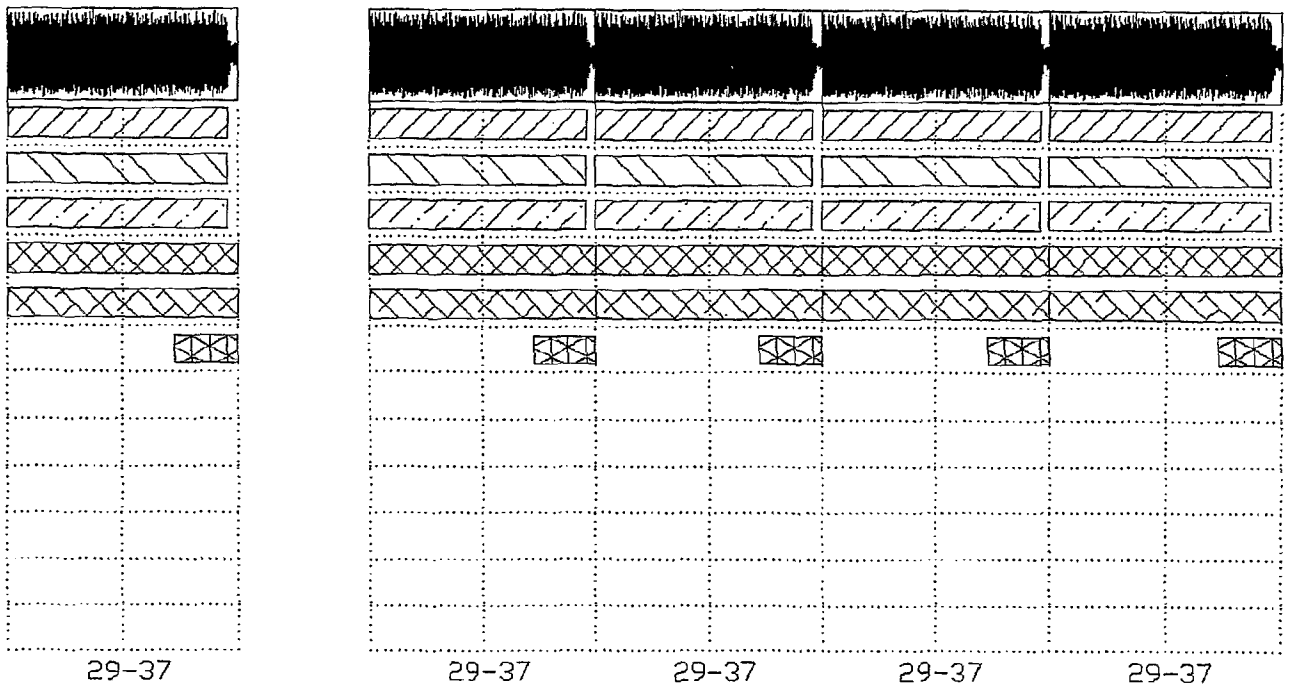
FIG. 17 shows an example of the MIDI looping functionality derived from the fact that the waveform has been appended with a MIDI time grid.

The interactive playback features/functionality the retrofile format will provide includes (but is not limited to) the following:

1. MIDI looping. The capability for a portion of a song to be 'looped' upon user request via the user designating loop start and end points on the MIDI time grid (for example bar 1-4). This capability stems from the fact that a MIDI time grid has been appended to the particular waveform song. The waveform song (which is synchronized with the MIDI) will 'follow the MIDI' and loop accordingly. This provides a user an easy means of isolating a section of a song for repetition. FIG. 17 shows an example of this functionality. Due to the fact that the waveform song of FIG. 10 is appended with MIDI data, if a user of the retrofile calls for bars 29-37 to loop then a playback device only need process the looping of the MIDI data and the waveform song will follow accordingly.

Figure 18:
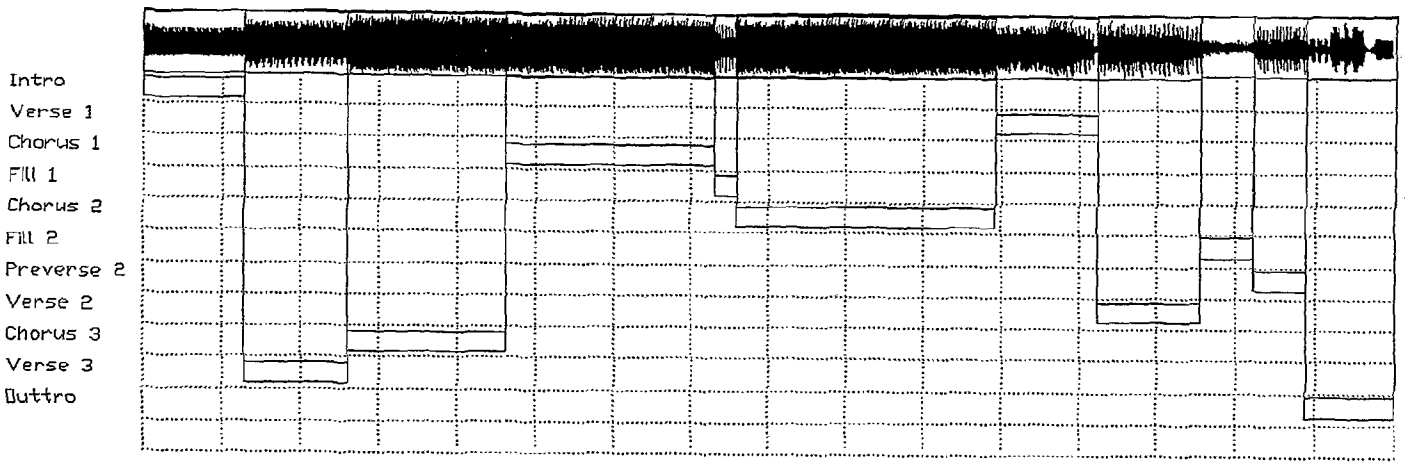
FIG. 18 shows the arrangement sections defined in FIG. 12 used to re-arrange the playback sequence of the waveform's arrangement sections.

2. Parts and arrangement sections. The capability for a song to be arbitrarily broken up into its primary 'arrangement' sections (such as verse 1, chorus 1 etc) and re-arranged. This capability stems from the fact that rendition part markers have been added to the appended MIDI time grid of the particular waveform song. A waveform song broken up into arrangement sections corresponding to MIDI time grid points is shown in FIG. 12. A re-arrangement of the waveform song of FIG. 12 using these arrangement sections and corresponding MIDI time grid start and end position values is shown in FIG. 18. A user's interaction with a song may be as simple as tapping on the next section of the song they want to listen to as the song plays and nothing else.

3. Track parts. The capability for the various MIDI (possibly also waveform/synthesis etc) tracks that have been appended to the waveform song to be arbitrarily broken up into 'parts.' This capability stems from the fact that a MIDI version of the particular waveform song has been mapped onto the MIDI time grid appended to the song. For example—the vocals MIDI track may be arbitrarily broken up into verse 1, chorus 1, fill 3 etc. These parts may coincide with waveform song arrangement sections due to the nature of the structure of music however this will not always be the case. Track parts provide a user quick access to various parts of MIDI tracks. For example, the MIDI tracks of FIG. 10 have been broken up into MIDI parts 10.1 that have been designated length and position based on the existence of a group of MIDI events (such as notes or synthesis data) at those positions. A retrofile can also include retrofit data which breaks up MIDI tracks into parts based on more specific reasons however such as by the type or description of the part, for example the vocals MIDI track might be broken up into verses, choruses, fills etc. further still, MIDI tracks might be broken up into smaller parts within the larger parts. This is shown using the vocals track as an example in FIG. 15. For example, within the chorus rendition parts, there may be one line of vocals that might be considered the 'catch phrase' of the song. This is the vocals line that people often think will be the name of the song. Even though this part may be accessible through the 'chorus 1' vocals track part for example, a user may want quick access to it and it alone and therefore a retrofit file may have it specified as a separate part as additional retrofile data. Track parts can also be applied to additional/alternative tracks/parts.

4. MIDI track remix. Using a retrofile and a retrofile playback device equipped with MIDI instruments such as synthesizers, samplers etc and audio manipulation functionality such as fillers/effects/LEDs etc; the capability of 'remixing' the provided MIDI (as re-rendered audio) back into the song. This is dependent on the waveform song having been retrofitted with a MIDI version of the song. The MIDI retrofitted to the waveform song need not only be event data but can also include all the other forms of MIDI data that can be preset (such as note velocity and after touch, filters, LED's and effects playback data etc—MIDI parameters of any type). In this fashion the playback device can deliver professional sounding renderings of MIDI tracks (which mimic the original waveform song tracks) that a user can remix back into the original waveform song. Due to the fact that the user of the retrofile is using the musical score of the original song synchronized with the waveform song, it is 'hard to sound bad.' The level at which the user decides to manipulate playback parameter's of the various MIDI tracks at their disposal is at their discretion. The level to which it is available to the user to manipulate in this fashion is determined by the level of sophistication of the playback device. A basic example of the sort of functionality this provides is that a user can let a song play as normal and add a synthesized copy of the original bass line into the mix and apply fillers and effects to it in order to creatively interact with the original recording.

5. Alternative MIDI truck remix. The MIDI provided with the audio can be more than just the original MIDI and can include remix alternatives. For example, the retrofile could come with a completely new bass line that is pre-programmed by a professional to sound good with the particular song. The MIDI track (bass line for example) could come with filters, effects, and parameter sweeps etc all preset by the professional that can be taken advantage of by a user as little or as much as they like. The alternative MIDI tracks could also come with more than one set of parameter settings. In this fashion a user can interact simply by choosing from bar to bar or from group of 4 bars to 4 bars etc which preset settings the alternative MIDI track will play back in. Thus a user is interactively participating with the playback of and creatively adding to an original waveform song in an environment in which it is again 'hard to sound bad.' This caters for musical novices. Alternatively, a more skilled/experienced user can modify the parameter settings of the alternative MIDI track quite dramatically. This caters for more skilled/experienced users all the way through to music professionals such us DJs. FIG. 11 is a representation of a retrofile (in terms of MIDI)

similar to FIG. 10 that includes alternative MIDI hacks. Of course the level to which the user can manipulate/modify the MIDI track and its resultant audio is dependent on the features incorporated in the playback device.

6. [The capability for a waveform track that has been retrofitted to the waveform song to be remixed back in with the original waveform song and other parts of the retrofile song.]

7. [The capability for a synthesis track that has been retrofitted to the waveform song to be remixed back in with the original waveform song and other parts of the retrofile song.]

8. [The capability for other types of tracks that have been retrofitted to the waveform song to be remixed back in with the original waveform song and oilier parts of the retrofile song.]

9. Tempo adjustment. The capability for users to adjust the tempo of components of the retrofile song (or the whole song) whether they are looped sections of the MIDI time grid, arrangement sections or track parts. This is done by adjusting the MIDI tempo and letting the 'audio follow along.' A TCEA would need to be utilized by the playback device such that an adjustment in tempo does not induce a corresponding change in pitch of the waveform song. This is the premiere element of retrofile functionality. Two bars of any two songs of different tempos can be played back in bar by bar synchronization by compressing and expanding each of their appended MIDI time grids to timing uniformity and then compressing or expanding one or both of their MIDI time grids to exactly match the other in terms of bars and beats. If the waveform portions corresponding to each part of the MIDI time grid is compressed and expanded 'following along' then the result will be two waveform loops that exactly match each other in terms of tempo and bar by bar synchronization.

10. Combination of various 'elements.' The capability for different elements of a retrofile song to be put together in an interactive and creative fashion. Elements of a retrofile song include looped segments of the MIDI time grid, arrangement sections, tracks and track parts etc. An important example of this functionality is the capability for mixing solo segments back together. For example, solos (section of the original song in which only one track is playing) from the same song (drums, bass, rift) could be mixed together to recreate a section of the song in which those elements are actually played together in the original rendition the mixed result should sound close or exactly the same as the part of the original song in which the different elements are actually played together depending on whether the solo parts of the original song are the same as when played with other tracks of the original waveform song. Different parameters could then be applied to the different elements in order to creatively interact with the remix in a fashion that would give the impression of 'being in the room whilst the original song was being recorded.' 'Jamming with your favorite band.' Alternatively, a section of a particular song containing only drums could he mixed with another section of a different song containing only a bass-line for a more original remix.

11. Dynamic recording and static saving of remixes. The structure of a retrofile enables the capability of the file itself being altered by a playback device and non-destructively saved in an altered format (I.e. the original retrofile is preserved as well). This means users can save their remixes. The structure of retro files also enables playback devices to have the capability of saving alterations dynamically via recording MIDI and other data (depending of course on the playback device also supporting this functionality). This means that a user can press play/record and the playback device will record the user's alternations/additions/manipulations 'on the fly.' In this fashion a user can record a session on the fly whilst concentrating on the bass line, save the dynamic recording, and play back the altered version whilst concentrating on something else (and so on until every last detail the user wanted to alter has been attended to). A user must be able to access, alter and save any part of the retrofile—a good example of this is users adding their own MIDI track creations for remixing.

12. File sharing capability. The capability that users can share their retrofile mix files (retromix files) with others. This capability can be implemented by saving alterations of an original retrofile song as just that—alterations. Due to the fact that the 'audio follows the MIDI' an altered retrofile need not contain any original waveform data but only instructions for altering MIDI and retrofile data. Thus a retromix file can be shared without infringing any copyright over the original waveform song data as no original waveform song data need be transferred. Obviously this would be a different file type to both type 1 and 2 retrofiles. Such files could be given a different file extension.

13. Playback devices can change waveform note pitches or drum sounds/timing during solos using TCEAS. This capability stems from the fact that a MIDI score has been appended to the appended MIDI time grid.

There are many examples of the different types of functionality this invention provides and the above list is only by way of example.

1a) User File Save.

If one or more retrofiles are used by an end user to create a mix, the user may wish to save the mix in order to show or share with other end users. In order that no copyrighted works (audio or score or a mix of the two) are being transferred it is desirable that, the saved mix is merely a set of instructions as to how to use a retrofile or retrofiles in order to render the mix.

By way of much simplified example a user may use 2 retrofiles in the following fashion:

Start.

Mix bar 7 of song 1 with bar 18 of song 2 and play these bars for 4 bars of time whilst increasing filler cutoff frequency for 2 bars and decreasing for two bars as per dynamic recording of cutoff frequency parameter alteration by the user.

Play bar 8 of song 1 for 1 bar,

Stop.

If a retrofile mix file (retromix file) is only saving instructions as per the simple example set out above there is no need for any audio or score to be saved and therefore retromix files can be shored amongst end users without breaching any form of copyright. Retromix files would contain MIDI data in order to record parameter changes over time and bar positions etc but no audio or MIDI from the original rendition. A user who obtains the retromix file would need either the type 1 retrofiles for songs 1 and 2 or the type 2 retrofiles for songs 1 and 2 and the corresponding waveform files for songs 1 and 2 in order to re-render the mix.

There could be 2 types of retromix files and the user saving the file could choose which file type to save a mix in. The first could be such that a secondary user can simply listen to the re-rendered result of the retromix file and the second could be such that a secondary user can open the retromix file just as the author had left it before saving it, as a retrofile. This means that the secondary user could press play and simply listen to the re-rendered mix or further add to and interact with the mix.

A simple form of coding for the retromix file formal might be (this file format is by way of simple example and is not exclusive):

1. Song number, bar or part number for each bar or part in a linear fashion. I.e. 1:8:181247 would mean that bar 1 of the retromix file would be bar 8 of song number 1,181,247. Thus a layout of a song could be coded as a comma separated sequence of bar:song:song-bar references. If two bar numbers were the same, this would indicate that these 2 song-bars should be mixed together.

2. Parameter changes over time in MIDI format.

3. MIDI (or waveform) additions (if any). E.g. an improvised additional melody with accompanying parameter-change data etc. Each addition would need to be assigned a bar or part number such that it can be placed in the linear outlay of the song by song number, bar or part number.

4. Song number, bar or part number for each bar or part placed in the non-linear section of the user interface. This would only be necessary for a type 2 retromix file—one in which it was intended other users could further change and interact with.

Figure 19:
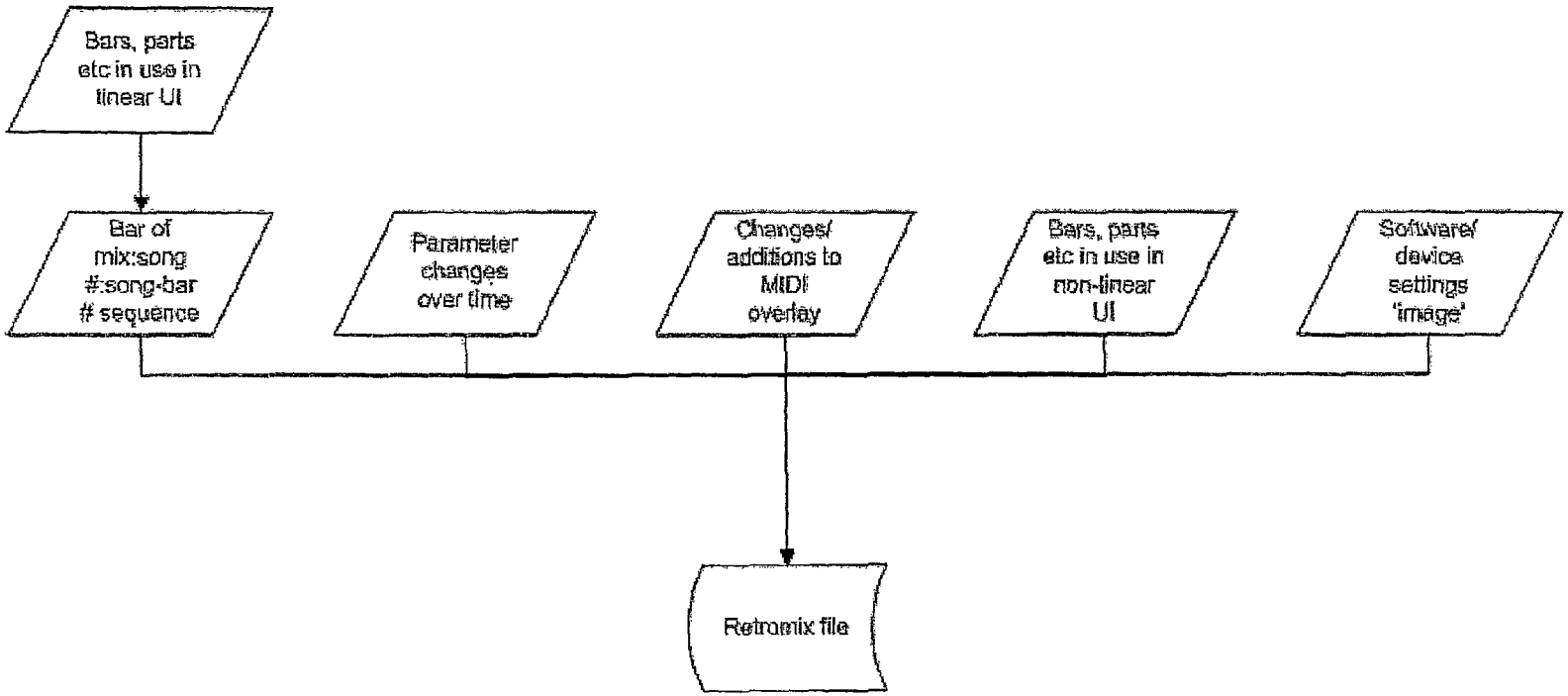
FIG. 19 shows an example process for the creation of a retromix file—a users file save of a retrofile.

An example process for the creation of a retromix file as per the above, is shown in FIG. 19.

1b) Audio and Score Copyright Merge.

It is an inherent property of the retrofile format that it merges two forms of copyright, audio and music score (as MIDI). The music industry currently makes the vast bulk of its money via selling audio, not MIDI. The process of merging the 2 forms of copyright gives the music industry the opportunity to sell every song ever made, all over again! Currently, a song costs 99c on iTunes for example. Let us presume that you could sell a type 1 retrofile (waveform and retrofile data) for $1.50 or just the retrofile data for songs (type 2 retrofiles) for 50c. This creates a rather large income stream for 'copyright owners' that was previously unavailable. In fact, up till now, copyright owners have been unable to obtain any more than a minimal income stream from the massive amounts of 'mixing' that goes on around the world. Copyright owners only receive money from the original sale of works even though in many cases mixed works would not be considered original enough under copyright law to be considered a compilation and be copyright exempt. This is because it is extremely difficult for copyright owners, or even particularly law abiding end users to keep track of all the music that is mixed for whatever purpose. It would be impractical in terms of time and cost for copyright owners to try and retrieve this income because they would have to sue each infringing individual, which basically means investigating each and every user of modern music creation software.

Retrofiles provide the remedy to this situation. If end users mix using retrofiles (which seems likely considering their hitherto unprecedented functionality) not only do copyright owners get a cut from files used in a mix but they get their cut in advance, all the time, even when the mix is considered original enough to be a compilation and thus avoid copyright law. This is a good arrangement for copyright owners!

2: Web Based File Format Sales Repository.

Conventional Music Creation Software Enabling User Retrofit of Waveform Songs with MIDI Time Grid Etc—Ability to Create Retrofiles.

For every retrofile that was sold a waveform song would need to have been appropriately retrofitted with a MIDI time grid, the original MIDI of the song and potentially other retrofile data (part markers/alternative MIDI tracks etc). This would require a cost outlay for each and every retrofitted waveform song.

An alternative to this cost outlay could be to build the ability to construct retrofiles into Logic Pro for example and give Logic Pro users incentive to create retro files. This solves one of the hurdles of the introduction of the retrofile formal being that the retrofile format system works best if there is a large collection of retrofiles to choose from so everyone gets to use their favorite songs rather than being limited to only a small collection of songs. If the company distributing retrofiles were to make the files itself users could certainly use the pool as it grows and it is probable that as the format became more popular and the company gained more revenue the pool of retrofiles would increase exponentially. It may be the case however that the fastest route to a large pool of retrofiles is to enable Logic Pro users (for example) to create the files and give them incentive to do so such as by paying them to do so. It would seem that the number of struggling musicians that this would provide an income stream for would lead to a quickly established and formidable pool of retrofiles! Of course each retrofile would need to be screened for errors and retrofile creators could obtain rankings for quality and consistency of work.

Indeed, it would seem probable that 3$^{rd}$ party companies could make a profit be making a business of creating retrofiles. 3$^{rd}$ party companies could not only create retrofiles but create alternative tracks to go with them and gel a return on the extra revenue derived. 3$^{rd}$ party companies such as music production studios (Sony etc.) could encourage the composers of the original waveform songs to provide the alternative MIDI/waveform/synthesis tracks themselves (as opposed to the creators of the retrofile data composing them). Such additions could be sold at a premium.

Distribution

Retrofiles could be sold in a similar fashion to that in which MP3 files are sold, via an online retailer such as iTunes for example.

There are two options for the distribution of retrofiles:

Type 1 retrofiles: The first, option is to sell the waveform song and appended MIDI/retrofile data together in a 'combination' retrofile. This would mean that appropriate copyright laws would need to be adhered to as the original audio work would be being distributed. Users who already own the audio of a particular song however may only have to pay an upgrade fee to get retrofile functionality. I.e. Users who had already downloaded a song from iTunes for example (and could prove it) may only need to pay for the upgrade (from a waveform song to a waveform song/retrofile data combination file type 1 retrofile).

Type 2 retrofiles: The second and most likely preferable option is to sell type 2 retrofiles which will enable retrofile functionality when the retrofile is used in conjunction with its corresponding waveform song. Although the original waveform song is required to be used for the creation of a type 2 retrofile, a retrofile of this type can later be separated from its corresponding waveform song and can be distributed independently. I.e. this type of retrofile would consist only of the additional data required to provide retrofile functionality (MIDI time grid/retrofile data etc). All that is needed to fully enable retrofile functionality is a reference in the type 2 retrofile that enables a playback device to appropriately utilize the retrofile and its corresponding waveform song in a synchronized fashion. In this way a user can obtain a waveform song and its corresponding type 2 retrofile completely independently of one another, and as long as a user has the correct waveform song and the corresponding retrofile a playback device can apply retrofile functionality to the waveform song, by using the data in the retrofile file to appropriately manipulate the waveform song. The two files (retrofile and waveform song) need never be recombined. The retrofile simply 'uses' the waveform song. Selling the retrofile as a separate entity (without the waveform song) means that there are no copyright issues involved as the original audio work would not be being distributed, merely data designed to 'use' the original audio work.

Another distribution method for retrofiles is retrofile pieces, for example, when a user obtains a retromix file, the user may need retrofiles in order to play or open it. Instead of forcing the users to buy the whole retrofile of each and every retrofile used in the piece, retrofiles could be sold in pieces. When a user opens a retromix file they could be automatically prompted to download the retrofile pieces they need to play or open it. It could be the case that once a user owns a certain percentage of a particular song they can download the rest of the song for free.

Complete Copyright Avoidance

Copyright issues can be completely avoided by using a proprietary time designation format (thereby not using MIDI if this causes any sort of copyright issue) and only providing alternative tracks. Thus neither copyrighted waveform songs nor copyrighted musical score are used in any way.

Online User Community

The fuel that users do not have to save their works containing any waveform or original MIDI data provides the basis for an dynamic and popular online user community via a specific website or websites.

Online remix competitions could be held.

Online live collaborative remix competitions could be held.

Portable Audio Devices

Whether retrofiles are sold as type 1 or type 2 files, users could transport, store and listen to/use the original wave form songs (and with appropriate implementation if necessary their own creations) on a portable audio device such an iPod or iPhone. If for example type 1 retrofiles were sold the retrofile could be designed such that a current iPod or iPhone (I.e. built before the retrofile format comes into existence) would read a retrofile as an MP3 file and simply playback the original waveform song as normal.

An important consequence of using a portable audio device such as an iPod or iPhone to store and transport retrofiles is that a more sophisticated playback device could be designed such that an iPod/iPhone could dock with it. This provides that users can transport their work to other playback devices (even playback devices of a completely different type) and continue to play them as is or manipulate them further. This is all available using current iPods/iPhones. [I.e. the portable audio device need not have any added functionality for this to occur; current portable audio devices could be used.]

Perhaps coming generations of iPods/iPhones could be outfitted with very basic functionality provided by the retrofile file formal such as looping 4 bars at a lower volume on the press of a button as an option instead of pause. Another simple use of the functionality the retrofile format provides in a device is for an iPod/iPhone to use the arrangement section markers in an iGruuv file to flick back and forth to the beginning of arrangement sections in the song much like the chapter back and forth function on a DVD player. Also future iPods could be introduced that are able to play retromix file formats.

Online Updates and Enhancement

A retrofile playback device (hereafter referred to as a retroplayer) could also gel updated and enhanced functionality via connection to the Internet, for example, in the case of retroplayer collaboration, the master retroplayer could check at the iTunes website (for example) for the most suitable start tempo for mixing two songs together by accessing a tempo calculated by user data/suggestions if so desired.

A retrofile could be a dynamic entity that is updated on a continual basis with new alternative MIDI/waveform/synthesis tracks, bug-fixes, timing error fixes and perhaps user add-on tracks and remixes. This could be used as further reason to make users want to legitimately own their files it could be that a user needs to 'validate' to access updates, remixes, share files and other downloads and to be able to collaborate online in the same fashion as 'Windows Genuine Advantage' or an online multiplayer game.

An online retrofile user community could be pushed forward in the same fashion as youtube or wikipedia 'user generated.' The retrofile online user community could be the next generation of music mixing, online collaboration and composition. Certainly this would be the goal.

3: Interactive Music Playback Device.

Figure 29:
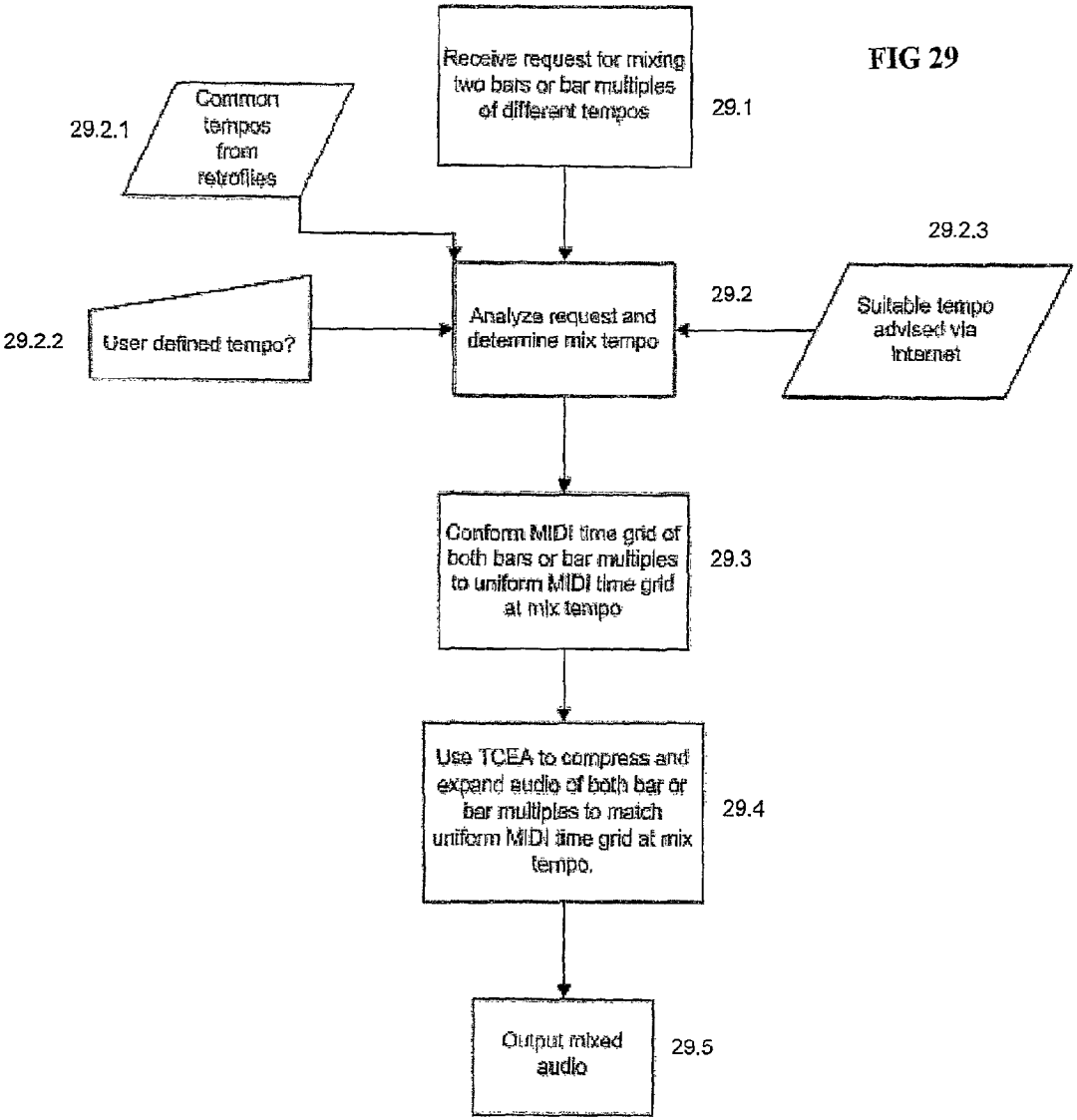
FIG. 29 shows an example of how a playback process may be implemented.

The premiere feature of the retrofile formal is the ability it gives to playback devices to mix any two bars, multiples of bars or pre-designated 'parts' from any two songs at the same tempo and in bar by bar synchronization. In order to achieve this, a playback device must undergo the following process (shown in FIG. 29):

1. Receive request for two bars (say bar 1 and bar 2) of different songs (say song 1 and song 2) to be mixed together. 29.1

2. Receive user input 29.2.2 input via Internet 29.2.3 or determine most suitable mix tempo using common mix tempos of retrofiles 29.2.1. 29,2.

Figure 30:
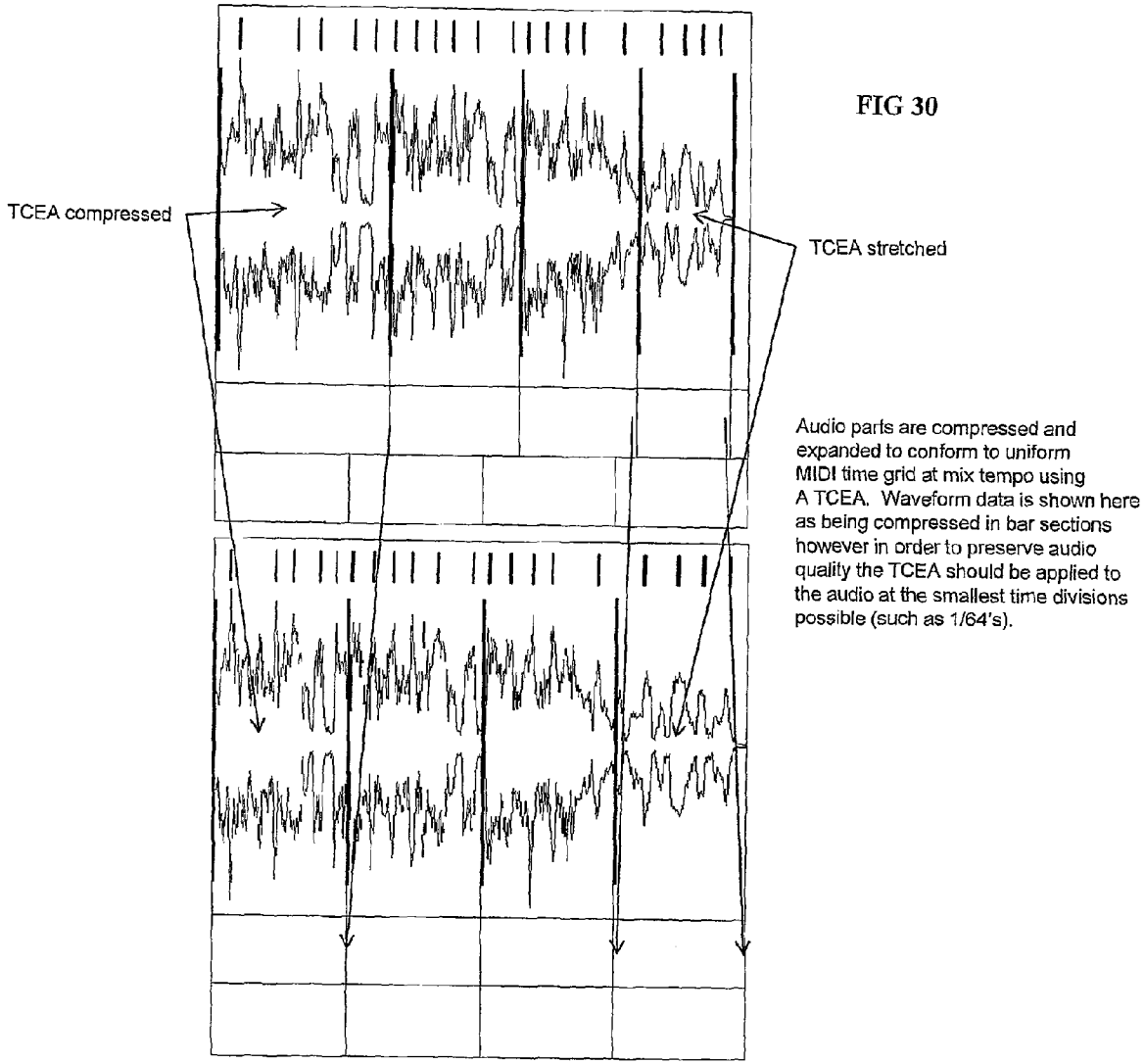
FIG. 30 illustrates a retrofile with a non-uniform appended MIDI time grid being conformed to a uniform MIDI time grid such that bars/parts etc of the retro file may be mixed with bars/parts etc of another retrofile that has also been conformed to a uniform MIDI time grid of the same tempo.

3. Conform MIDI time grid of both bars to a uniform MIDI time grid at mix tempo. This is shown in FIG. 30. 29.3.

4. Use TCEA to compress and expand audio of both bars to match uniform MIDI time grid at mix tempo, this should be applied to the audio using the smallest time divisions of the retrofiles MIDI time grid to preserve audio quality. 29.4.

5. Play back mixed audio. 29.5.

One of the most advantageous features of the retrofile formal is that the level of functionality it provides is determined by the features of the playback device. [Clearly retrofile functionality and playback can be achieved entirely in software and this is included in the definition of a device for the purposes of this document.] This means that a variety of playback devices con be used to implement the file formal that can be designed to appeal to the full spectrum of users; from children to music beginners of all ages to professional music producers/DJs. Such playback devices could be sold at incremented costs tailored to the market to which they are designed to appeal; less expensive devices for children, more expensive devices for music professionals etc. Another advantageous feature of the retrofile formal is that regardless of the level of sophistication of the playback device if the user does nothing, the retrofile playback device will simply play back the original waveform song in its entirety. If the user wishes to interact with and add to the song however; a vast array of interactive and additive features are made available by the format. It is apparent to the author that the preferable way to roll out the retrofile system is by introducing it as primarily an advanced media player with interactive capability and letting, the end users slowly discover and themselves popularize the advanced interactive and collaborative functionality the platform provides.

iPhone:

It has become apparent to the author that the preferable user interface/platform for a retrofile playback device is a multi-touch-screen computer. Since the launch of the iPhone platform it has become apparent to the author that the preferable multitouch-screen computer platform for a retrofile playback device is the iPhone or another device with the same or similar features. This is because of what the retrofile system intends to achieve which includes (not exclusive):

- To bring music interaction (mixing/manipulation) to the masses by making music interaction available all the time and instantly (or at the touch of a finger). One way to achieve (his is to make the retrofile system a software application on a device people carry around with them all the time, like a cell phone, in this case an iPhone.
- To bring music interaction to the masses by requiring very little skill, knowledge or talent from the user.
- To make music playback an interactive experience that provides a feeling of 'instant gratification' to the user by making them feel like a professional DJ-instantly, by making them sound like a professional DJ-instantly.
- To bring music interaction to the masses by making people feel like they are interacting or 'jamming' with their favorite band/music. The intention is to make people feel like they are 'in the room' when the particular song was originally recorded.
- To be a collaborative platform where users can 'jam' together either in the same room or across the Internet.
- To make interaction with music an average person will undertake on a frequent basis. The scope of this intention is given much aid by implementing the retrofile system on a platform such as the iPhone, a platform end users will carry with them all (or a lot of) the time and everywhere they go.

Using the iPhone as a platform for the retrofile system brings music interaction to the masses very efficiently as it does not involve the user setting out to specifically buy a piece of software or hardware and carry it around with them. A user docs not even have to choose the various retrofiles they wish to use in advance. Due to the way Apple intends to roll-out iPhone applications (as of 6 Mar. 2008) a user can download iPhone applications straight to their phone over the cell phone network. This means that not only can a user download the retrofile platform itself as an application but they also have access to the retrofile pool all the time.

The intention to make interaction with music an activity an average person might undertake is quite a challenge. The retrofile system as an application on an iPhone provides that it has a better chance of catching on in this way because:

- It is always there.
- You are not required to interact with it.
- When not in use as a music interaction tool, a retroplayer is simply a media player and this is for most people how it will start life—in fact it will likely be initially rolled out as simply an advanced media player with the enticing add-on of interactive capabilities. A new media player, which offers opportunity for new and exciting ways to pass the time whilst, on the train to work. A particular advantage of the multitouch interface is that a very sophisticated piece of software can present itself at varying levels of complexity.
- A user might try out a very simple retroplayer function such as 'scratch a part over a song' which is described in more detail later but involves simply waving your iPhone around to scratch an audio part as a counterpart to the particular song you happen to be listening to. Completely intuitive, requires no instruction and a lot of fun.
- It is the hope of the author that this will encourage the user to experiment with more advanced retroplayer functionality and due to the fact that utilizing retroplayer functionality requires essentially no musical skill, knowledge or talent that the user is not scared away in the same way people are seared away from learning a musical instrument (because learning a musical instrument requires time, effort, skill, knowledge and talent). Also people are interacting with songs they get to choose and are familiar with which can only help.
- Once retroplayer begins to catch on and the ability to collaborate anytime, anywhere and without, interfering with anyone else (no-one else can hear) becomes known, it is the authors hope that retroplayers will become a new and advanced social utility.

In order to have full functionality as intended on a multitoucb platform a retroplayer requires (not exclusive):

- A computer memory, processor and storage powerful enough to meet retroplayer system requirements.
- A high level operating system featuring advanced audio.
- An audio out jack.
- A multitouch screen.
- Wireless internet (wifi).
- Wireless internet (through cell phone network).

The iPhone has all of this and more. In terms of computing power (memory, processor and storage) it has ample, it features the full version of Mac OS X which runs Logic Pro 8; it has an audio out jack and a multitouch screen.

By way of example, the retrofile music interaction system as an application on an iPhone (retroplayer) could have the following general features (not exclusive):

- Every user interface slider, knob, toggle etc would enlarge upon touching it so a user can make more precise adjustments in similar fashion to how the keys on the QWERTY keyboard of the current iPhone enlarge when depressed for easy visual confirmation a user has pressed the intended key.
- Each area of GUI would enlarge to full screen upon an appropriate command. 'Two-finger touch-and-expand' or press the 'full screen' tab at the edge of each GUI area are good examples. A variety of methods could be used to achieve this however.

By way of example, the retroplayer could have the following windows that can go full screen (not exclusive):

- x,y parameter manipulation touchpad.
- Interactive keyboard.
- The entire screen would be cut up into 16 (for example) pads for tap drumming.
- Non-linear music playback section.
- Linear user playback section.
- Oscillator section.
- Effects section.
- Send effects section.
- filter section.
- Filter and amp envelope section.
- Module flow section.
- Waveform part selector section.

Figure 20:
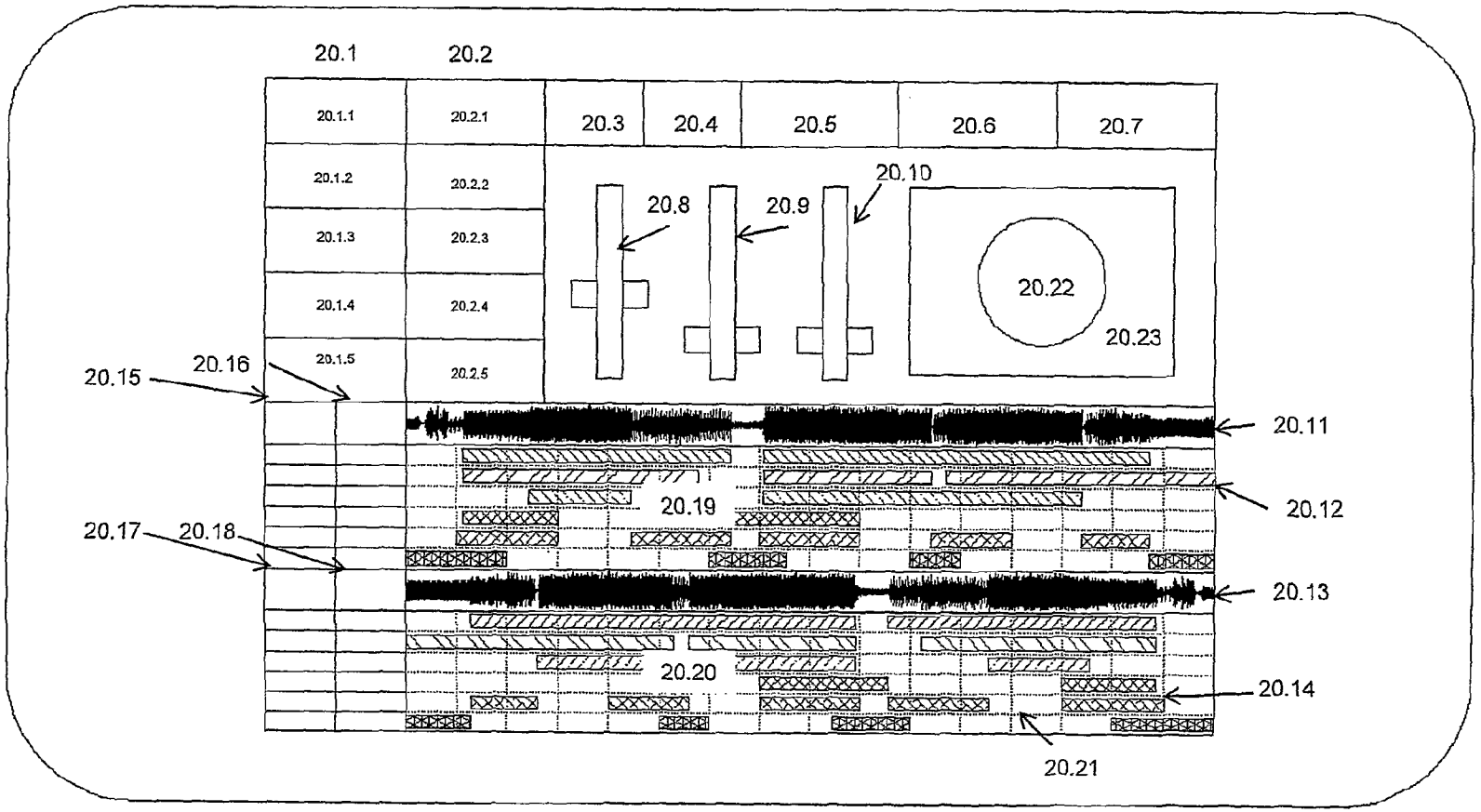
FIG. 20 shows an example multitouch-screen interface for a retroplayer utilizing an iPhone.

Example iPhone Multitouch-Screen Interface Application:

An example multitouch-screen user interface for the iPhone is shown in FIG. 20. [It should be appreciated that this interface is merely by way of example and a person skilled in the art would be able to see the myriad of interface possibilities available to a retroplayer using the multitouch interface.] A particularly relevant and useful advantage of the multitouch screen for a retroplayer is that whilst the entire graphical interface shown all at one time may take up some considerable space, a multitouch screen lends itself to flipping between various layers of complexity and the different interface sections with case. Again, this makes it possible for a very complex program to present itself at varying levels of complexity and via many windows which can go full screen or enlarge when touched for use. This means the one platform and one program can provide interfaces for music interaction suitable for musical novices through to music professionals.

It is the contention of the author that the simplicity of the interface will mean the interface novices will use will also be the base interface music professionals will use.

In the example interface of FIG. 20 the multitouch screen is broken into 3 primary sections, the non-linear inlet face section at the top left of the screen containing columns 20.1 and 20.2, the parameter interaction section at the top right of the screen containing 20.3 through 20.10, 20.22 and 20.33 and the linear interface section which fills the bottom half of the screen.

In this example the user is currently using 2 retrofiles from their particular retrofile collection; both retrofiles 20-19 and 20-20) are shown on the display with their waveforms (20-11 and 20-13) on top of the appended MIDI time grid 20.21 and added MIDI score (20-12 for 20.19 and 20.14 for 20.20). These could have been chosen from a split screen where the users retrofile collection is shown on the left and the files to be used are shown on the right and are placed there in drag and drop fashion. If the user had chosen 1 or 3 retrofiles, 1 or 3 retrofiles would now be being shown on the bottom half of the display.

The simplest way to interact with the retroplayer from 'rest' is to touch the circle 20.22 within the x,y touchpad 20-23. Upon being touched the circle enlarges into a circular play, stop, pause etc touch circle similar to the iPod. If play is chosen the unit begins to play. By default only the waveform track of the top-most retrofile 20.19 will play, in this case waveform 20.11 will play in normal unaltered order from left to right. Retrofiles and their associated wave forms can be rearranged in vertical order via drag and drop. In this scenario the retroplayer is acting simply as a media player and the track on/off column (under and including 20.15) will be dim except for 20.15 which will be lit. The track could be interacted with by adjusting global track parameters on the default parameter interaction screen such as filler cutoff frequency 20.8, filter resonance, 20.9 and effect level 20.10. An entertaining way to interact with the platform in first instance is to touch the x,y parameter pad 20.23 anywhere outside of 20.22 (the transport circle 20.22 will disappear at this point) and 'strum' the pad in time with the rhythm. The default parameters set to the x,y parameter pad such could be such that the users strumming introduces slight but noticeable oscillations in frequency and resonance to the global output.

This does not however begin to utilize the functionality provided by the retrofile format. At any time the user can add a midi track to the mix by simply touching its on/off toggle switch in the column 20.15 (whereby waveform 20.11 is in row 1 of column 20.15). By default the next column 20.16 is set to track volume and so touching row 3 of column 20.16 will bring up an enlarged slider and MIDI track 2 (from the top) of retrofile 20.19 can be gradually brought into the mix by raising the slider. By touching anywhere in the adjust level columns 20.16 and 20.18 and any of the areas 20.3 oscillator, 20.4 envelope, 20.5 filter, 20.6 effects or 20.7 EQ the top right panel will change from the 3 sliders and circle/x,y pad to either the oscillator, envelope, filter, effects or EQ section for that particular track. Here a user can adjust MIDI or waveform track parameters or change the default slider in columns 20.16 and 20.18 to any other by dragging that slider, knob etc to the appropriate surface in the column. The second waveform song can be brought into the mix simply by touching its corresponding on/off toggle, the above example of interaction is linear manipulation however and still a user has barely scratched the surface of the functionality the retrofile format provides.

It is the ability to match tempo and provide bar by bar synchronization of any two bars/parts etc of any two waveform songs that is the premiere functionality the retroplayer provides. Not only is this the retroplayers premiere functionality but it is a functionality that is intuitive and easy to use and provides for 'instant gratification' by making an average user sound like a professional DJ 'instantly' with very little skill, knowledge or talent. This functionality is best utilized in a non-linear user interface as provided by the 5 rows of columns 20.1 and 20.2. 20.1 starts as the 'playing now' column and 20.2 as the 'playing next' column. Let us assume the user has used 20.22 to press stop and a play session can be started again from scratch. Since the diagram is black, and while a lot of the interface cannot be shown but assume that the different, arrangement sections of waveform 20.11 for example were broken up as per FIG. 12 and different sections were shown in different colors. The different breakups of waveform 20.11 (arrangement sections, solos etc) into colored sections could be toggled between by pressing anywhere in the waveform and 20.15 at the same time. A user could move an arrangement section of waveform 20.11 into row 1 of the playing now column 20.1 (to start with) by simply dragging and dropping. A user could 'grab' a section of the waveform or any MIDI track 'by bars' by touching the waveform or MIDI track with two fingers at left and right bar locations. When this occurs the waveform or MIDI track expands in view between and around the users fingers and the precise by bar location of the left boundary/finger and the right boundary/finger can be located (the selected area would automatically snap to bar positions and to suitable numbers of bars such as 1, 2, 4, 8, 16 etc) before dragging and dropping the bar or bar multiple into a row of the playing now column. In this example let us assume the user has dragged two bars of a 'drums only' section of waveform 20.11 into row 1 of 20.1 and 4 bars of a 'bass only' section of waveform 20.11 into row 2 of 20.1 using either drag and drop by arrangement/waveform section or drag and drop by bars and pressed play using 20.22. Music will begin to play. Both sections dragged into the playing now column 20.1 will play in tempo and bar by bar synchronization. The 2 bars of drums only waveform will repeat, twice in order to match the 4 bars of the bass only section. Therefore with a few intuitive touches a user has already created a unique and ready to be creatively manipulated mix based on waveform 20.11. Say now the user presses row 2 of 20.1 and pad 20.5 at the same time. The section containing the 3 default sliders and default x,y and transport controls will change to the filter section corresponding to row 2 of column 20.1. If the user now presses the cutoff frequency slider (which as always will enlarge upon being pressed to provide more precise control) and moves it upward the user will be manipulating the sound of the bass-line of waveform 20.11. Say now the user drags chorus 2 of waveform 20.13 into row 1 of the playing next column 20.2. This action will not affect playback or 'enter the mix' yet. If the user swipes downwards along column 20.2 the retroplayer will begin playing the mix collated in the playing next column 20.2 at the next common bar multiple of the parts playing in the playing now column. I.e. the retroplayer will move from the end of the multiple of bars in column 1 20.1 into playing chorus 1 of waveform 20.13 (being all that has been added to column 2 20.2) in perfect tempo and bar by bar synchronization. Now the playing now column has become the playing next column and vice versa. More columns can be added if necessary. Indeed effects could have been applied to chorus 1 by touching row 1 of column 2 and 20.6 at the same time and choosing and manipulating an effect in advance of bringing it into the mix.

The application is set up so that once play is pressed all manipulations are dynamically recorded (as 'instructions' as per above) so that once stop has been pressed the user has the chance to save the dynamic recording. The user can then replay the retromix file which will replay any dynamic manipulations; the user can then introduce further dynamic manipulations which can be saved in the same retromix file. This means a user can concentrate on manipulating one part of a mix and then replay and concentrate on another area to slowly build-up a complicated set of interactions/manipulations. The user would also have the option of saving static mix settings.

Figure 21:
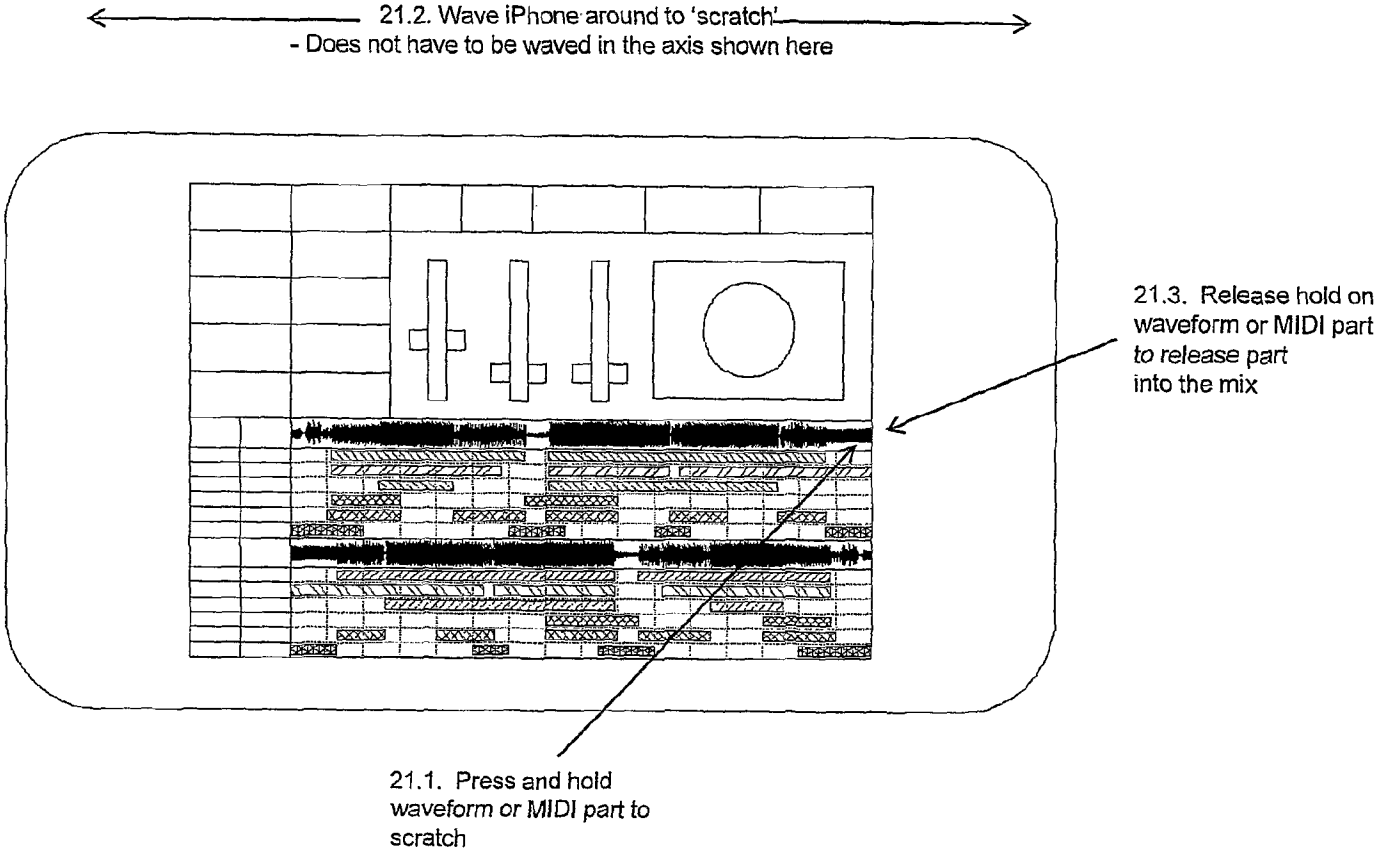
FIG. 21 illustrates how the iPhone's accelerometer could be used in a novel fashion in combination with the retrofile format, in order to achieve the 'scratching' of one piece of the waveform song of a retrofile whilst the waveform song plays in the background as normal.
Figure 22:
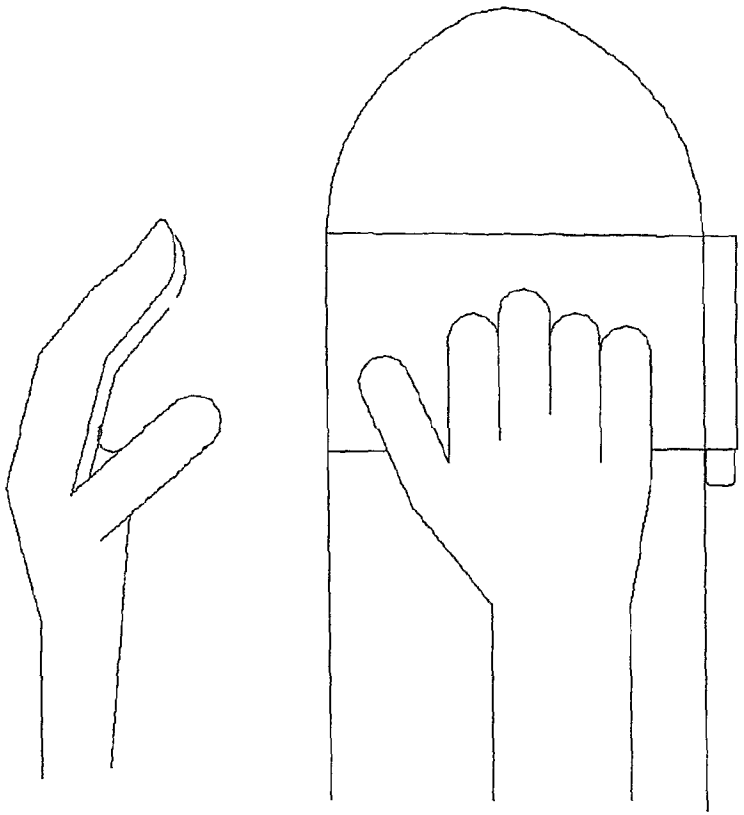
FIG. 22 illustrates how the iPhone's accelerometer could be used in a novel fashion in combination with the retrofile format, for a user to tap their thigh with both hands and tap their foot in order to drum in like fashion (in terms of hand and foot use and placement) to a 'real' drum set.

Advanced Interactivity Options Provided by the Combination of the Retrofile Format and the Features of the iPhone:

The x,y,/z (3 axis accelerometer) in the iPhone can be used to interact with the retroplayer in several unique and exciting ways:

- An audio 'part' could be assigned to the x axis of the accelerometer and waving the iPhone from side to side could be linked to the playback position and thus the particular audio 'part' would be 'scratched.' Undoubtedly one of the most appealing aspects of mixing with 'turntables' is the natural and intuitive feel and general fun associated with scratching. It is apparent to the author that regardless of any other functionality that the retrofile formal provides the simple act of listening to your favorite song whilst waving your iPhone around in order to add in scratches of an appropriate audio 'part' and then 'letting the sample go' and have it seamlessly blend into the mix in perfect liming would be irresistibly fun for the average person. Scratching a single audio stream never sounds good because the flow and tempo of the song is interrupted. In order to make a scratch sound good the song needs to continue to play while another audio part is scratched along with it. With retroplayer and the functionality the retrofile format provides a user can choose which part of the song to scratch (a vocal catch phrase/a sound effect) at the touch of a finger whilst the rest of the song continues to play as normal, and scratch it by waving the iPhone around. This will sound good and a user can make it happen from thought to scratching to sounding great in the time it takes to think about it. An example of this simple functionality is shown in FIG. 21. for continuity let us assume the user is using the same interface and 2 retrofiles however at this time is simply using the retroplayer as a media player and waveform 20.11 is playing in normal linear fashion. To scratch an associated part into the mix the user must simply press and hold their finger on that part 21.1, say the vocals catch phrase as specified in FIGS. 13 and 14, and wave the iPhone around to scratch 21.2. (Scratch axis could be user defined or 'all or any.') The part can be released into the mix (by default to loop play once and stop) by releasing hold of the part 21.3. This functionality could also he achieved by waving a finger across the multitouch screen starting from the audio 'part' the user wishes to scratch.
- A parameter can be assigned to each axis such as cutoff frequency, resonance and lo-fi depth (an effect). By moving/waving the iPhone around you can interact with the music (a MIDI or waveform part or track) in a very intuitive fashion. Getting used to all three axes may take some time so a user could start with just assigning high cut filter cutoff frequency to the x axis of the iPhone for example, applying the parameter to the bass line and waving the iPhone slightly from side to side in time with the music. [Single (or more) axis parameter changes over time via accelerometer input could be dynamically recorded.]
- A user could ad-lib improvise a bass line or riff for example by assigning pitch to the y axis (in increments of the notes used in the part being interacted with, whether scales or just particular notes—so the user cannot play a note that would not sound right) and cutoff frequency to the x axis to emulate, a rhythmic feel and effect depth to the z axis. Or one axis at a time to make it easier. [It would be necessary that either only the pitch increments used in the part or in the scale used in the part are assigned to the ad-lib increments in this manner the user cannot play a note that will sound 'wrong.' This is described in more detail later.]
- A user could combine all 3 of the above and assign a scratch to one axis, a parameter to the second axis and an 'ad-lib riff creator' (series of automatically created pitch increments used in the part being played) to the $3^{rd}$ axis.
- The accelerometer could be used for drumming. A user could hit their leg with the iPhone this could be assigned to be a bass drum. The iPhone has a 3 axis accelerometer so the face of the iPhone the user hits their leg with can be made to affect the resultant output.
- Alternatively a user could place or preferably strap the iPhone on/to the top of their right thigh (touch-screen down) and tapping it from the top using their right hand could provide a bass drum sound and tapping it sideways from the left using their left hand could provide a snare drum sound for example.
- Another option is to have the iPhone strapped to the right hand side of a user's right thigh. In this fashion the user could introduce accelerometer data into the iPhone by tapping their top and inside thigh (of their right thigh) and let the accelerometer receive data through the thigh tissue. Clearly the thigh tissue would alter the received accelerations however this is likely a good thing. Tapping down is one axis, tapping across is another axis. Tapping your foot on the ground would provide the $3^{rd}$ axis. This exactly matches a bass drum, high bat and snare drumming set up in terms of hands, feet and the actions they perform on a 'real' drum set. Therefore a drummer who has previously utilized real drums would have no problems in moving from real drums to iPhone virtual drums. In this fashion a retroplayer user could drum along to a retrofile song. Depending on the sensitivity of the accelerometer in the iPhone, perhaps scratching (rubbing your hand back and forth) across the surface of your top thigh could be interpreted as 'scratching data.' The input from such an arrangement could also be used for other purposes such as triggering events or providing ad-lib input data. Such an arrangement is illustrated in FIG. 22.

Figure 23:
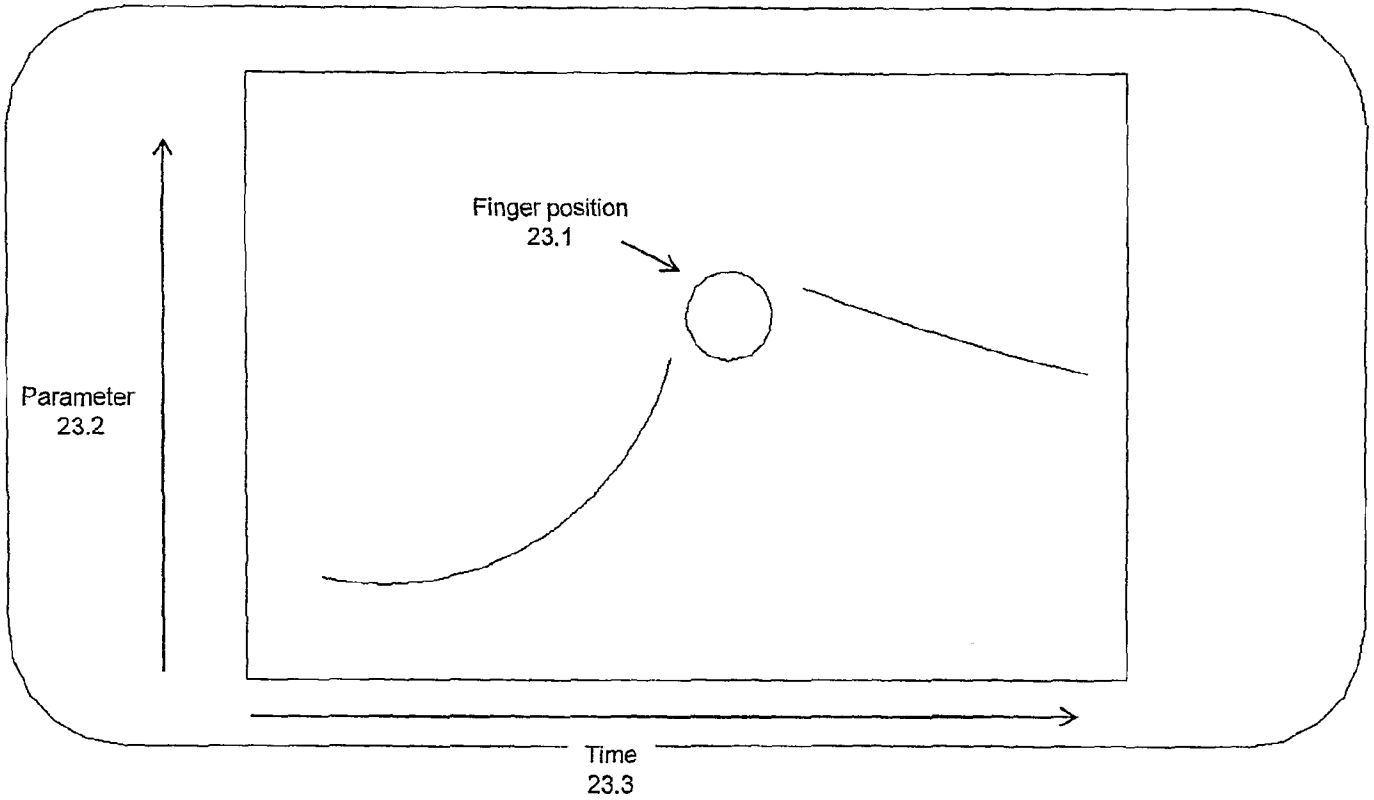
FIG. 23 illustrates how parameter sweeps could be graphically drawn by finger using a multitouch-screen interface.

Capacitive multitouch screen—this provides a number of unique opportunities for the iGruuv interface:

- A good capacitive touch screen can detect the presence of a finger before it touches the screen and any changes in the shape of the finger after touching the screen. This data can be used to provide velocity and aftertouch parameters when the screen is in keyboard mode. [This also means that areas of the screen can be enlarged as a user goes to touch them for precise control rather than enlarging the area after the screen has already been touched.]
- The screen can be used a keyboard with velocity, aftertouch etc.
- The screen can be used as a pad drum kit with velocity, aftertouch etc.
- The x,y parameter pad can be used to designate parameter sweeps over time like on a graph. A general property of a multitouch screen is that parameter changes over time can be 'drawn.' Cutoff frequency if often used (particularly in the electronic music genre) to create rhythmic fluctuations in an instrument track such as a riff or bass line. These can be created via simply drawing the parameter changes over time on a graph with parameter level on the y axis and time on the x axis. Such parameter changes over time are often referred to as 'parameter sweeps.' Drawing on a graph on a multitouch screen is particularly useful for creating parameter sweeps for retrofile parts. A simple example is shown in FIG. 23.

[The above is merely an example of the very beginning of the functionality the iPhone could provide as a platform for the retrofile system. A person skilled in the art will immediately see the large and varying user interface and graphical interface possibilities provided by the combination of the functionality provided by the retrofile format and the utility provided by the iPhone as a platform.]

Multitouch Screen Laptop:

Of course another device which contains all the features necessary for the full implementation of retrofile functionality as described above for the iPhone is a multitouch-screen laptop. Whilst a multitouch-screen laptop has a larger multitouch-screen and therefore more versatile interface and of course more computing power, it suffers the disadvantage that it is not something that a user is likely to have on them and use all the time in the same fashion as a cell phone. The intention of bringing music interaction to the masses in a fashion whereby people do it on a regular basis is harder to realize on a laptop than a cell phone.

Hardware Playback Devices Designed to Implement Retrofile Functionality:

Whilst a multitouch-screen interface is the preferable embodiment the current invention can also be implemented in older generation hardware device embodiments. Due to the very recent advent of the multitouch laptop and the iPhone (particularly the iPhone SDK public release—6 Mar. 2008) it is worthwhile describing the retroplayer in its hardware embodiments because they bring to light many features which could be used in the multitouch-screen interface.

The hardware retroplayer could store the retrofiles itself or a portable audio storage device such as an iPod could dock with it in order to provide the necessary files or both.

The retroplayer can also have important features that were not explained under the 'file format' heading above:

A retroplayer could be equipped with a 'retroplayer keyboard' which can provide an interactive learning experience and an easy means of playing 'ad lib' with no knowledge of musical theory such as scales, chords etc as well as a means to add to the remix in a fashion musicians are more familiar with.

[This function could also make use of a previous invention by the same author entitled "Instant Musician 2."]

Notwithstanding that inclusion however a 'retroplayer keyboard' is essentially an included (with the retroplayer device) or plug-in keyboard for the retroplayer device that has a series of LEDs or other signaling apparatus on each key. Due to the fact that a retrofile comes with a MIDI version of its corresponding waveform song it can be quickly determined (by the playback device or beforehand and included as data in the retrofile) which notes are used to play each particular track of a song, for example, if each of the 12 notes of every octave has a green LED on it and if a user has set the retroplayer to a bass line MIDI track, the notes that are used to play (ONLY the notes that are used to play) the particular bass line can be lit up across every octave of the keyboard. This may only include 5 notes of every 12 note octave (for example). In this fashion a user can play along with the song (jam with their favorite band) by tapping on the lit notes on the keyboard. Due to the fact that the user will therefore only be using the notes used to create the particular (rack of the original waveform song which will therefore be in the right 'key' (the same key the original waveform song is in), to a large degree it does not matter in what order or timing the user presses the notes in, the result will not sound out of place. Indeed the result is likely to sound good. A user could even turn down the volume of the bass line they wish to play ad lib whilst still having the appropriate keys lit up such that they could attempt to replace the said bass line with their own creation using the same notes. Any original creation in terms of timing and order of notes will be in the same key as the original song and using the same notes as the particular track of the original song (the bass line in this example) and therefore is likely to sound good.

A further function of the retroplayer keyboard is to have the same LEDs change color (or another set of LEDs for each key of a different color light up) when the notes of the original waveform song are played. This means that not only the 5 notes used in a 12 note octave are lit green such that a user can see which notes are used to play the particular track, but that as each note is used in the playback of the song the corresponding note's LED changes color for the length of the note depression. This means that if a user could press the keys as they light up, in time with their lighting up, the user would be playing the particular track just as it is played in the original waveform song. Again this means that a user can turn down the volume of the particular track whilst still having the keys light up as they are being played in the original waveform song and attempt to play along with them. If a user succeeds in doing so, they will be playing the bass line of the original waveform song.

The user could of course turn both the LED functions on or off. An important advantage of retroplayer keyboard is that the skills learnt in playing a retroplayer keyboard would be fully transferable to a regular keyboard. I.e. if a user learnt the bass line of their favorite rock and roll song on a retroplayer keyboard, they could then play it on any other keyboard (or piano or other analogue instrument) and it would sound the same.

Both of these functions could obviously be used for alternative MIDI tracks etc.

Figure 24A:
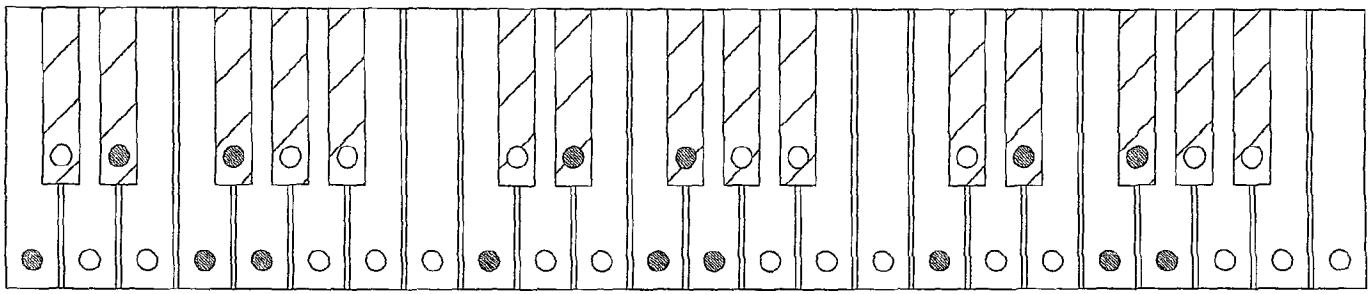
FIG. 24 shows an example of a 'retroplayer keyboard.'
Figure 24B:
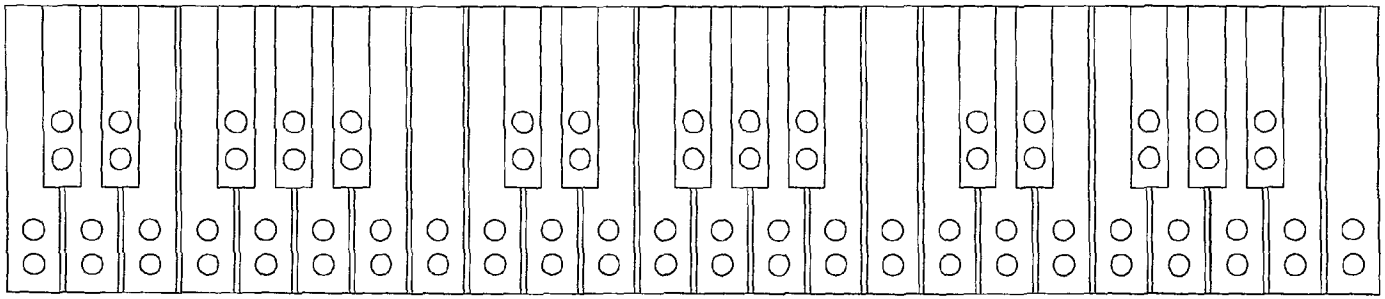

A keyboard with LEDs on each key that could be implemented in the fashion described above is shown in FIG. 24. FIG. 24*a* shows 5 keys of each octave lit to indicate the 5 keys used in the creation of an original waveform song's bass line as per the above example. The LEDS of FIG. 24*a* change color when the particular note is actually played during the playback of the particular track in the song, FIG. 24*b* shows a retroplayer keyboard in which two LEDs are utilized, one to indicate which notes are used in the creation of the original track, and another to indicate when they are actually being played.

The idea behind a retroplayer keyboard could be applied to other MIDI instruments that could be designed to interface with the retroplayer—a MIDI guitar with LEDs behind each fret on the fret board for example.

[Clearly this could also be implemented on any multitouch-screen user interface. The idea of only lighting up notes that are used in a particular track translates into the ad-lib function for the iPhone either in x,y touchpad or shake the iPhone accelerometer mode in the sense that only the notes that are used in the particular track are applied to the pitch axis. Thus the user cannot play a 'wrong note' even whilst frantically waving a cell phone around for example.]

A Range of Playback Devices

The following is an example list of the functionality a retroplayer device could deliver using the functionality the retrofile format provides for:

By arrangement section rearrangement.

MIDI looping. The waveform song 'follows the MIDI.'

Static saving of remix settings.

Dynamic recording of remixes, (for example, parameter changes such as cutoff frequency over time.)

File sharing capability.

MIDI track remix.

Alternative MIDI track remix.

Alternative waveform or synthesis track remix.

Track parts. (Catch phrases, main riff etc)

Combination of various 'elements.' (E.g. mixing loops with section arrangements.) An 'element' is a 'part' that the retrofile format provides and includes MIDI (and thus waveform) loops, arrangement sections, track parts, MIDI and waveform tracks etc.

Tempo adjustment. (Utilizing the MIDI time grid as a guide.)

Mixing two retrofile songs together. (Conformed to a user defined tempo by utilizing tempo changing software/hardware and using the MIDI time grid as a guide and letting the 'audio follow the MIDI'

Collaborative mode.

Retroplayer MIDI keyboard (and other MIDI instruments).

Microphone input, dedicated vocals mixer channel and vocoder.

[Not all of the functionality the retrofile formal could provide is listed above and the list above should only be taken by way of example.]

A range of playback devices could therefore be introduced to the market to appeal to a range of people (from children through to music professionals) and the retrofiles (altered and saved or left unchanged) would be fully transferable amongst the different devices as would be the skills learnt by users of the various devices. The amount of functionality that the retrofile format provides implemented in the playback device could vary between playback devices in older to both appeal to different user markets and graduate cost. Fortunately the cost of the unit would rise in proportion with the likelihood of the target user being able to spend more money on the unit. I.e. a playback device designed for children could be made with a small amount of functionality and therefore less expensively whereas a playback device designed to utilize the full suite of functionality provided by the retrofile format and therefore appeal to a more sophisticated user would be more expensive. [Very fortunately the iPhone application could be extremely sophisticated at low cost and the same program would he used for everyone, only the interfaces would vary in complexity.] An example range of hardware devices is listed below:

[The following list should be taken by way of example only. All iterations of playback devices a person skilled in the art would conceive are taken to be within the broad ambit of this invention.]

Rectroplayer Nano

Figure 25:
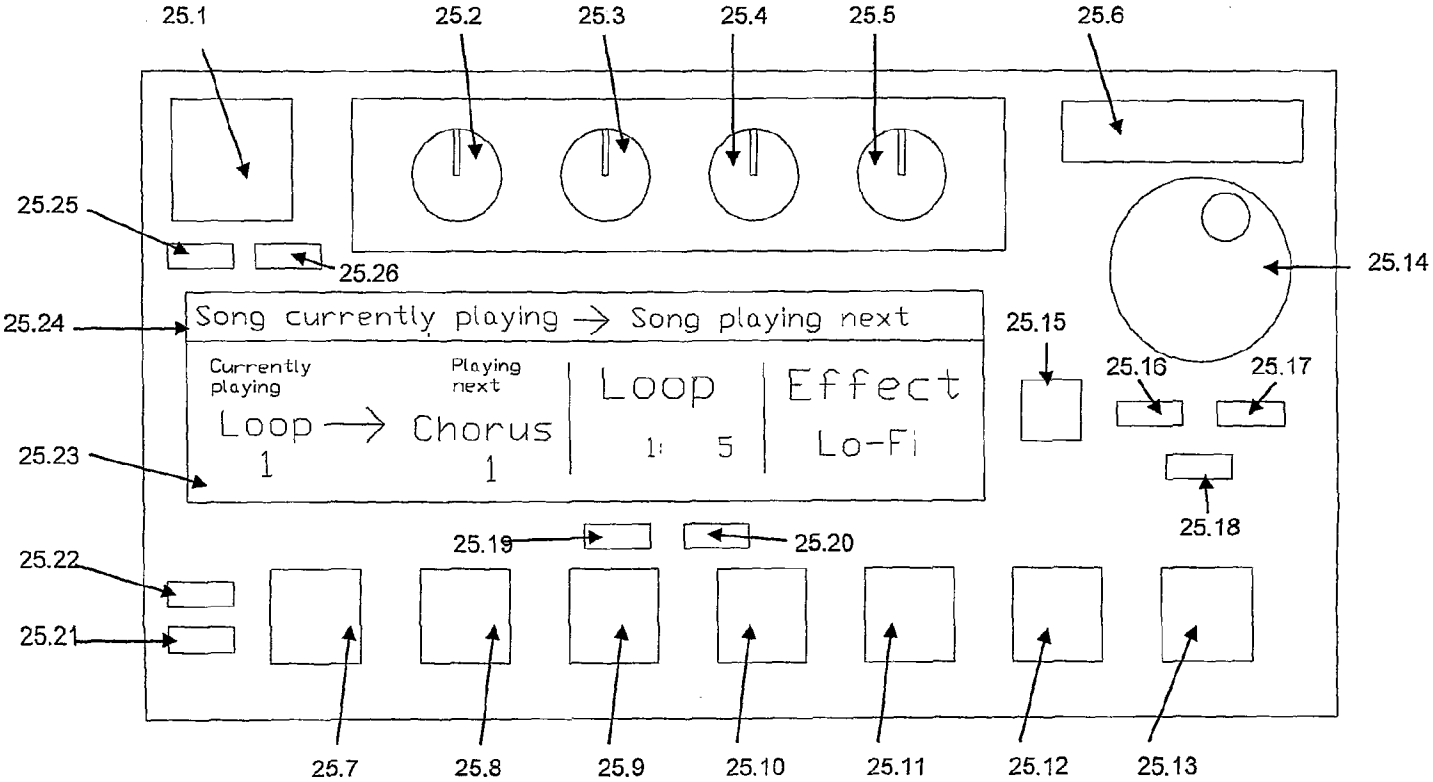
FIG. 25 shows an example hardware 'Retroplayer Nano.'

The Retroplayer Nano could be a relatively unsophisticated version of the retroplayer aimed at children (say 9-14). This device could be limited to simply implement section rearrangement and MIDI looping combined with a filler and a few effects. An example of a Retroplayer Nano is shown in FIG. 25. An iPod is used as the storage means for iGruuv files in this example and docks with the Retroplayer Nano at 25.6. The power button 25.1 is used to turn the unit, on and off. The 4 knobs lo the right of the power button are volume 25.2, cutoff frequency 25.3, resonance, 25.4 and effect level 25.5. The rotary switch 25.14 is the universal selector. The bottom row of buttons are arrangement selection/loop buttons which are pre-assigned to arrangement sections such as intro 25.7, verse 1 25.8, chorus 1, 25.9, verse 2 25.10, chorus 2 25.11, crescendo 25.12, outtro 25.13. the buttons to the right of the LCD screen are effect select 25.15, stop 25.16, play 25.17 and record/save 25.18. In operation the user turns the unit on and selects the first 'element' to play (loop or arrangement section). The user has a choice of the 7 arrangement sections or a loop to play first. The 7 arrangement sections are selected simply by pressing the corresponding selection button 25.7-25.13. Loop hotkeys are assigned via first toggling the 7 arrangement section/loop buttons between arrangement section and loop setting by choosing loop 25.21 from the 2 buttons to the left of the arrangement section/loop buttons (arrangement section 25.22 and loop 25.21). Holding a loop button down (25.8 for example) causes 'Loop' to flash in the remix display 25.23 and then a loop 'boundary' is selected by pressing the left loop boundary button 25.19 and rotating the universal selector until the left boundary is appropriately selected (in this case bar 1) and then pressing the right loop boundary button 25.20 and rotating the universal selector until the right boundary is appropriately selected (in this case bar 5). When play 25.17 is pressed, the unit will play either the chosen arrangement section or the chosen loop in a repeating fashion until either another arrangement section or loop is chosen to play next. If for example another arrangement section is chosen by pressing its corresponding button near the bottom of the unit, the device will finish playing its current arrangement section or loop and then move onto the next chosen arrangement, section. In this example the unit is currently playing the loop of bars corresponding to loop hotkey 1 (bars 1 to 5) which is displayed on the screen under "Currently playing" and the unit is to play arrangement section chorus 1 next (displayed under "Playing next"). The user can manipulate cutoff frequency 25.3, resonance 25.4 and effect, levels 25.5 to interact in a manner other than by rearrangement of the particular waveform song. Such manipulation however is limited to manipulation of the waveform song in this example however and the user cannot manipulate (in-even add) the MIDI version of the waveform song. Effect type is chosen by pressing the effect selection button 25.15 and rotating the universal selector 25.6. Songs can be played in sequence by pressing the current song button 25.25 and rotating the universal selector 25.14 to choose the song currently playing and the next song can be selected by pressing the 'next song' button 25.26 and using the universal selector 25.14 to choose the song to play next. The 4 parameter knobs are set to apply to the element or song currently playing if button 25.25 is pressed and to the element or song to play next if the 25.26 button is pressed. If none of the parameter settings of the segment to play next are modified, the next element or song will play beginning with the default parameter settings. If the record/save button 25.18 is pressed during or before playback the unit will record the dynamic manipulations of the user (knob movements/button presses as to time) and if the record/save button is pressed when the song is finished or stopped the unit will save the remix and prompt the user to outer a filename to save it onto their docked iPod.

[The seven buttons on the bottom row are also useful in the sense that there are 7 notes in a diatonic scale. This is the topic of another invention by the same author entitled "Instant Musician 2."]

The iGruuv Nano thus has the following functionality from the above list:

Section rearrangement.

MIDI looping.

Static saving of remix settings.

Dynamic recording of remixes.

File sharing capability.

The 'Retroplayer Nano' playback device described above is merely an example and should not be taken to be limiting of the scope of this invention.

Retroplayer Mini

The iGruuv Mini could feature much the same functionality as the iGruuv and look and feel much the same at a lesser cost. All the same functionality could be provided, just less of it; synthesizers with less presets, effects modules with less effects etc.

Retroplayer

Figure 26:
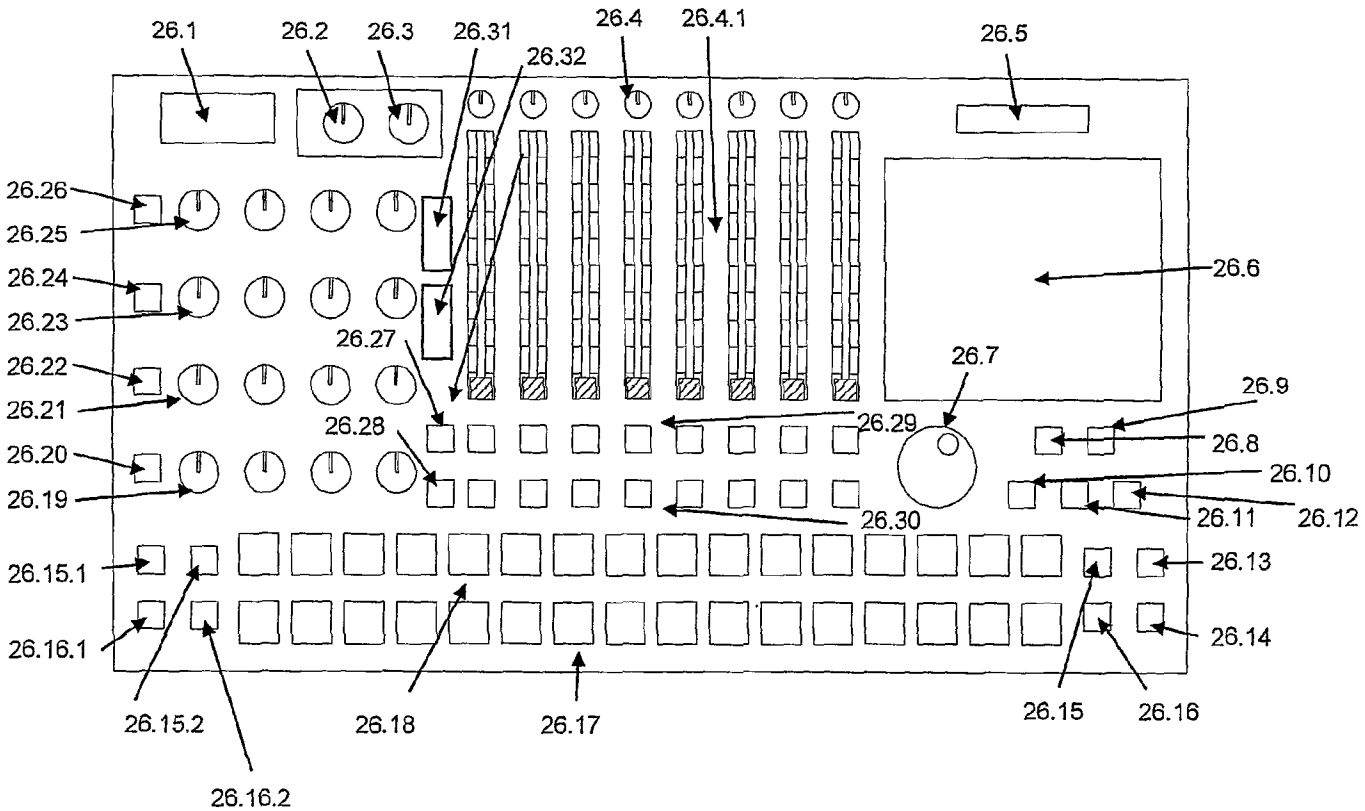
FIG. 26 shows an example hardware 'Retroplayer.'

The Retroplayer could be the mainstream hardware version of the playback unit and feature all of the functionality the file format provides in a professional package (I.e. the included electronics package, MIDI synthesis, effects etc would cater for novices to professionals). An example layout of a Retroplayer is shown in FIG. 26. The power button 26.1 is used to turn the unit on and off. The two knobs to the right of the power button are volume 26.2 and tempo 26.3. The row of knobs 26.4 above the volume (and other parameter adjust) faders 26.4.1 are pan knobs for each of the tracks. Each of the faders 26.4.1 and pan knobs 26.4 would typically be assigned to a particular track. The faders are toggled between effecting MIDI tracks and waveform loops/arrangement sections by toggle button 26.31 and toggled between tracks 1-8 and 9-16 by the track toggle button 26.32. An iPod docking pod 26.5 is included so that an iPod can be used as a transport and storage vehicle for iGruuv files. The unit may also be equipped with USB ports (and other media readers) such that users could also utilize USB memory sticks etc as transport and storage media. A large LCD screen 26.6 provides the graphical user interface (GUI) for the device. [A MIDI piano roll could be displayed onscreen when desired as a learning tool for iGruuv keyboard.] A universal selector 26.7 and enter 26.8 and exit 26.9 buttons are provided in order for a user to interface with the GUI. The device may also come with a mouse port if desired for easier interface with the GUI. Stop 26.10, play 26.11 and record 26.12 buttons provide means for basic control and dynamic and static recording of remixes or parameter settings. There are two layers of 16 buttons at the bottom of this example iGruuv which perform several important functions. Each layer of 16 buttons (26.17 and 26.18) represents 16 different elements of two different songs, such as arrangement sections or loops. (If the iGruuv is only being used to play one song however the bottom layer is used as a drum sequencer as commonly found in machines such as Roland's MC-505). Toggle buttons 26.15 and 26.16 toggle the two layers of 16 buttons between arrangement section mode and loop mode. When in loop mode each of the buttons represents 4 bars so to easily setup a loop of particular song a user simply defines the loop space by holding down the corresponding loop selector button (26.15.1 or 26.16.1) and choosing the loop boundaries by selecting two of the 16 buttons in the particular layer. If for example a user selects buttons 5 and 7 of the 16 buttons the song will loop between bars 21 and 29. Loop hotkeys are selected by holding down a particular button in the loop layer and using the universal selector 26.7 to designate loop boundaries. The hotkey is then recalled by first pressing the hotkey select button for the particular layer (26.15.2 or 26.16.2) and then the desired hotkey. When each layer is in arrangement mode the arrangement, sections are automatically assigned in chronological order from left: to right along the 16 arrangement section buttons for each song. Buttons 26.13 and 26.14 are used to select which song all the buttons/faders/knobs etc on the entire iGruuv are to apply to, song 1 26.13 or song 2 26.14. If a MIDI track, alternative MIDI track or other synthesis or waveform track is selected all the buttons/faders/knobs etc on the entire iGruuv will apply to that track. This example iGruuv has 4 effects knobs in a row 26.19. These start off at default effects such as delay, reverb, compression and overdrive however are customizable by holding down the effect select key 26.20 and rotating the desired effect knob until the desired effect is shown on the LCD screen 26.6. Above the layer of effect knobs 26.19 are 4 knobs 26.21 in a row for 4-pole parametric equalization. When these are adjusted a frequency graph will be displayed in the LCD screen 26.6. Above the layer of EQ knobs 26.21 is an envelope (attack, decay, sustain, release) layer of 4 knobs 26.23 which are toggled from amp envelope to filter envelope via toggle button 26.24. Above the layer of envelope knobs 26.23 are 4 knobs 26.25 which are cutoff frequently, resonance, LFO depth and LFO rate from left to right. Button 26.27 toggles the top layer of buttons 26.29 below the faders 26.4.1 between part select and part mute. The bottom row of buttons 26.30 below the faders 26.4.1 mute the various parts of the MIDI drum track (kick/snare/hi-hat etc). The element of the same or other song that is 'playing currently' or is to be 'played next' would be controlled in the same fashion as described for the iGruuv Nano above.

The 'iGruuv' playback device described above is merely an example and is should not be taken to be limiting of the scope of this invention.

Retroplayer Professional

Figure 27:
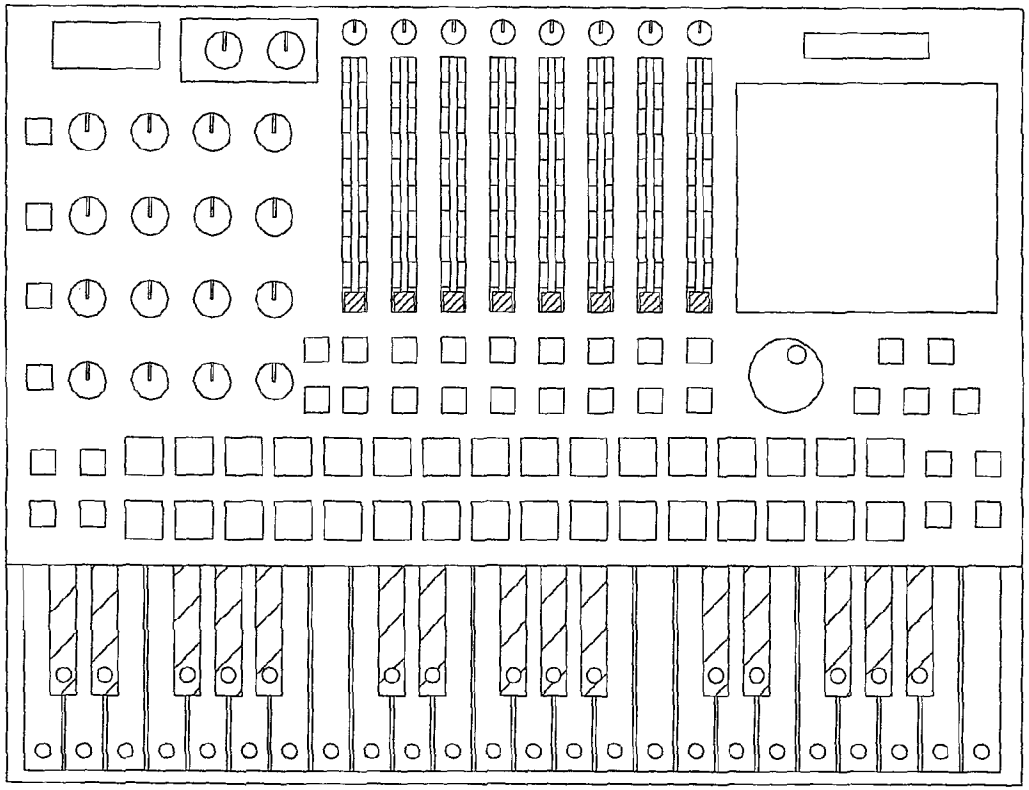
FIG. 27 shows an example hardware 'Retroplayer Professional.'

The Retroplayer Professional could be the flagship Retroplayer product aimed at DJs and music production professionals. It could be essentially the same as the Retroplayer however have in/out/interface options more suited to integration in a studio environment such as fire wire interface with DAW software, ADAT in/outs etc. The Retroplayer professional could also be equipped with an inbuilt retroplayer keyboard. An example embodiment Retroplayer professional is shown in FIG. 27.

Transferable Skills/Files Between Devices

It is a considerable advantage of the retrofile format (and therefore range of playback devices) that all the skills that a person may learn or employ on one device will be fully transferable to another device in the retroplayer range. More importantly however it is also the case that any remix files that a person creates on one device are fully transferable to any other playback device. It is only the functionality that a user can later apply to a retrofile that will differ between devices. This provides a level of comfort for the purchaser of an 'Retroplayer' for example in that their skills, knowledge and ultimately remixes and original creations are not of any less value on a machine of different functionality. A 'Retroplayer' user can seamlessly move to being a 'Retroplayer Professional' user for example. This is a good reason for having the different named devices look much the same and have only the level of functionality differ between them.

Software Retroplayer

A retrofile play back device could also be provided as software. Such software could interface with 3$^{rd}$ party or dedicated external control surfaces etc. A software retroplayer could be designed to easily interface with DAW and other similar software such as by being a (Virtual Studio Technology) VST instrument.

Example Use of a Hardware Retroplayer Described Above:

The following is an example of how a user could use the example Retroplayer playback device above to creatively interact with a waveform song:

find a section of a waveform song (song 1) in which it is only the bass-line that is playing and designate a loop boundary around the section and assign it to a loop hotkey.

Set the iGruuv so that all its parameters are to act on waveform song 1 and bring the cutoff frequency down to around 20%.

Bring all MIDI track faders down lo the bottom (no volume) and mute them.

Raise the MIDI drum track fader to 80% volume and mute every drum sound except the kick drum. (An alternative MIDI drum track could be used if so desired.)

Press play/record. Only the looped waveform bass-line section will play with a filter acting on making it sound 'dull.'

Slowly increase the cutoff frequency (of the waveform song bass-line loop) up to full level over a number of bars.

Release the mute on the MIDI drum track (only the kick drum will play).

Wait a number of bars and then release the mute on the other drum sounds at the same time as muting the waveform bass-line. Now only the MIDI drum track is playing.

Increase the default assigned delay effect on the MIDI drum track until it is appropriately 'tweaked' and then select the chorus 1 button from the 16 button arrangement section layer for song 1. When playback reaches the end of the next bar of MIDI drum track the chorus 1 arrangement section of the waveform song will therefore begin to play. (The chorus 1 arrangement section will not just begin to play when you press the button, but will do so at the next available 'juncture,' in this case at the beginning of the next, bar of the MIDI drum track. This of course can be customized.)

At the same as the chorus 1 arrangement section begins to play quickly reduce the volume fader of the MIDI drum track to zero. A user could also bring in a predefined vocal solo element track part to play just during the transition to give the transition some 'smoothness.'

After a few bars have played press the loop hotkey for the bass-line section of the same song designated previously to bring the bass loop of the same song back into the mix. In this fashion a user is now mixing two waveform parts of the same song.

In the above fashion a user has interactively created their own creative introduction to the first chorus of a waveform song using two elements of the original waveform song and elements of the original MIDI version of the waveform song (and possibly provided alternative elements if desired). A user could then mix in a second retrofile song as per the example below;

The chorus 1 arrangement section of song 1 and the designated bass-line loop is now playing and will repeat in time until a further command is given.

Drop out the bass-line of song 1 by re-pressing its loop button. The loop button will go from blinking (to designate playing) to dark (to designate not playing).

Set the iGruuv to have all settings apply to waveform song 2. Bring all MIDI fader volumes to zero.

Define a loop section of song 2 that will mix well the chorus 1 arrangement section of song 1. You do not want the output to be too 'busy' so a vocal solo might be a good start. This can be designated by loop boundaries or it may already be preset track part element of the waveform song. Let us assume in this case that it is a preset track part element of waveform song 2 set to fader 14.

Toggle the faders from MIDI to waveform and from tracks 1-8 to tracks 9-16.

Select track 14 by pressing the appropriate part select button in the part select button layer.

Hold down the effect select button and choose a custom effect to later apply to the waveform vocal solo.

Raise the volume of waveform track 14 of song 2. (the vocal solo portion of waveform song 2 will rise in volume appropriately).

Add the pre-selected custom effect to the vocal solo of waveform song 2 until it is appropriately tweaked.

At the same time as you press the chorus 2 arrangement section button for waveform song 2 press the vocal solo element button designated to button/track 14 of song 2 and the chorus 1 arrangement section button of song 1.

At the next juncture (being the end of the longest element currently being played) (he vocal solo element designated to button/track 14 of song 2 and the chorus 1 arrangement section billion of song 1 will go from blinking to dark and stop playing and the chorus 2 arrangement section button 7 for waveform song 2 will go from dark to blinking and begin to play.

Now slowly and then quickly reduce the tempo to 0 and press stop. Press stop again to save your creation and assign it a filename. It can then be replayed, further manipulated and resaved.

In the above fashion a user has interactively mixed various MIDI and waveform elements of two retrofile songs. In the above example a user has performed a sophisticated piece of 'DJ'ing' at the touch of a few buttons, a performance piece that would take many hours of preparation using conventional methods. A novice Retroplayer user however could achieve this with simple instruction. The difference is that with retroplayer, all the preparation has been done for you in advance.

It can be seen that using the functionality that the retrofile formal and playback device provides there are near limitless possibilities for a user to creatively interact with one or more of their favorite songs. The above example should therefore not be taken to limit the scope of the invention in any way but rather as bringing to light the possibilities.

4: Interactive Collaboration Device.

Retroplayer's could be linked together via MIDI, USB, Ethernet, wireless Ethernet (a/g/n) or over cell phone networks for example in order for two or more users to musically collaborate. Due to the fact that it is the MIDI that is being manipulated and the audio simply 'follows the MIDI' the linked retroplayer's essentially only need communicate via MIDI (and retrofile data which is mostly MIDI markers and metadata). Not only does this make collaboration easy to implement but the data transferred in order to enable collaboration is minimal in the sense that only MIDI and retrofile data need be transferred, not band-width intensive waveform data. This means that wireless networking technologies could be utilized and easily be able to cope with the data transfer requirements of collaboration for two or more users. This also means that no copyright laws are being breached as no copyrighted works are being transferred between collaborating users, merely instructions on how to 'use' copyrighted works. It would appear preferable that a master retroplayer provide the overall tempo however each retroplayer would output the mixed audio (the audio output would be the same for all collaborators). Retroplayer device users control aspects of the collaboration and the input and actions of each and every collaborator is shown on each and every collaborators device in real time.

The following is two examples of how this could occur:

1. Users could collaborate on the same song. The following is an example of such an arrangement:

In this mode one retroplayer could be set to master and the others to slave. The master retroplayer is master of tempo more than anything else as this is the one thing that must be common amongst the collaborating retroplayers. An example of such collaboration could be that the master retroplayer user manipulates the arrangement of the songs (order of parts, loops, arrangement sections etc the various elements of the songs) and the slave retroplayer users manipulate the parameters of the various elements the master retroplayer has designated to play in order. Alternatively the collaboration could be more 'ad hoc' whereby the master retroplayer simply controls the master tempo and the other retroplayer users could add and manipulate any track or element of a track they desire. It could be that the retroplayer users collaborate to form a cover of the original waveform song using only minimal parts of the original waveform song and mostly the various original MIDI version tracks of the song, the provided alternative MIDI and waveform tracks and ad lib creations using an inbuilt or separate retroplayer keyboard.

2. Users could collaboratively mix two or more different retrofile songs. The following is an example if such an arrangement:

User 1 could choose waveform song x and press chorus 1 and user 2 could choose waveform song y and press verse 2. When the master user presses play, the songs will play from the start of chorus 1 and verse 2 respectively. The master retroplayer could determine the mix tempo to begin with and a master user could alter the tempo to which all songs will sync to if so desired. The two or more users could then operate their retroplayers essentially independently (other than the master tempo) and introduce elements and manipulations etc as they please.

In collaboration mode if a user starts to ad lib on a retroplayer keyboard the Retroplayer can be set up so that the notes he/she uses light up on every other users retroplayer keyboard. Therefore the other users can play ad lib using those notes and therefore will automatically be in the same key and not sound out of place. Collaborators can therefore be musically coordinated with absolutely no knowledge of musical theory, scales etc. This would obviously work particularly well however if the first user to ad lib (the one who defines which notes are to be lit up on every other users retroplayer keyboard) is a proficient keyboard player—alternatively the first ad-lib player can stick to the lit up notes provided by the MIDI track data and therefore guarantee no-one plays a 'wrong note.'

Figure 28:
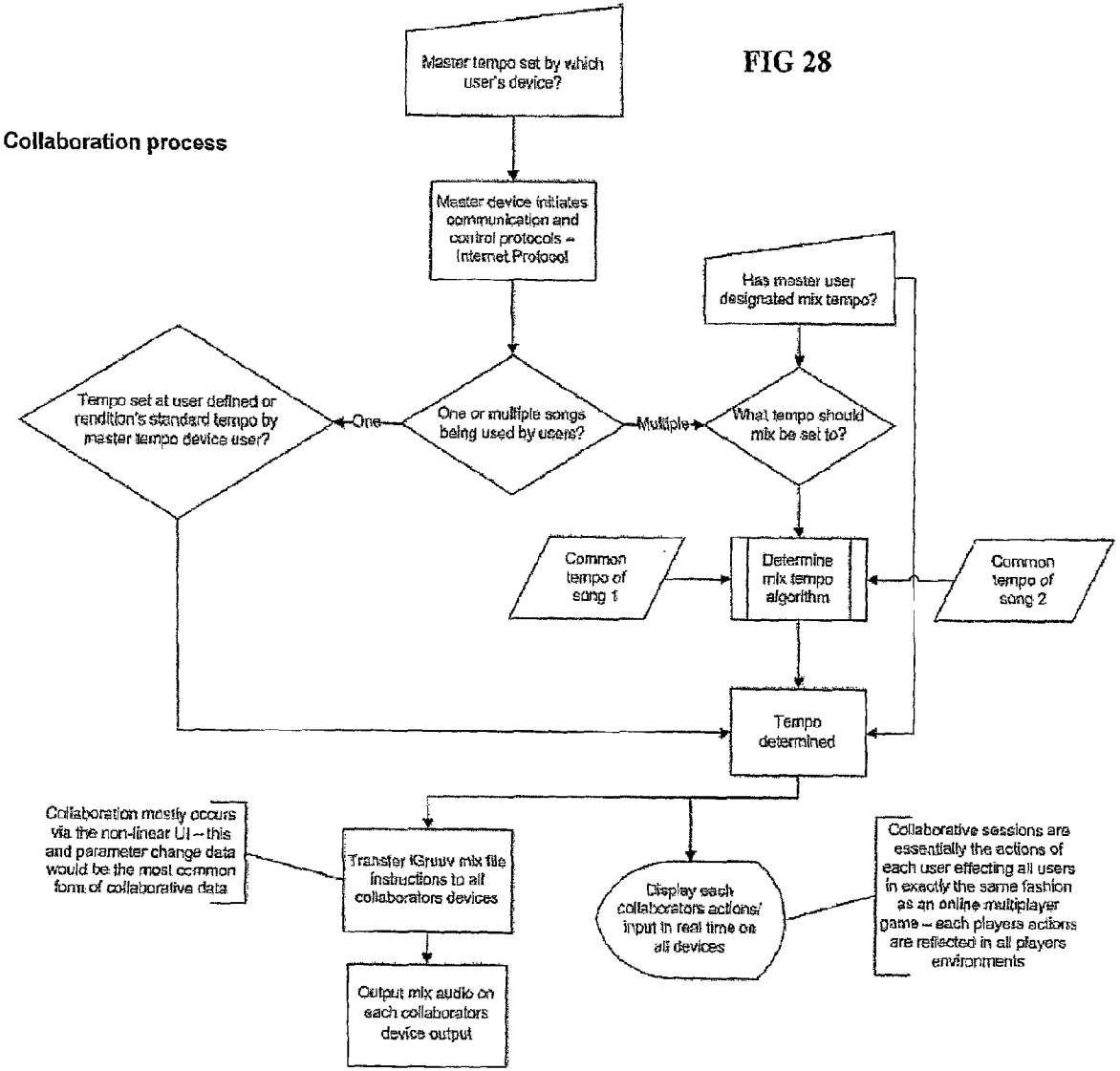
FIG. 28 shows an example of how a retroplayer collaborative process may occur.

An example of how part of a collaborative process may occur is shown in FIG. 28. It should be noted that this is merely by way of example and a person skilled in the art could see the many varied ways in which such collaboration could occur.

Retroplayer Karaoke

Retrofile songs could be provided with removed vocals such that karaoke can be performed in the traditional sense as well as a performer playing back the song in a their own creative fashion either individually or collaboratively.

Several Retroplayers could be set up (in a Karaoke club for example), one as the master (which could be operated by a club hired music professional/DJ) and others which anyone can operate.

Retroplayer Collaboration Online

Due to the fuel that the amount of data transfer required in order to enable retroplayer collaboration is minimal (being only MIDI and retrofile data rather than waveform data) users could collaborate online (over the Internet) in the same way that 3D gamers collaborate online.

5: Retroplayer Playback Device as an Audio Manipulation Device.

In order to gel the most out of the functionality provided by the retrofile formal it is preferable that the retroplayer lake advantage of the full suite of audio manipulation technology that is currently available in order to isolate audio tracks from one another, for example, a user may want to add a provided original or alternative lead riff in replacement of the lead riff in the audio at a particular section of a song. Audio manipulation soft ware/hardware is as far as the author is aware still unable to successfully split a mastered waveform song into its component tracks. This can be achieved to some degree however by intelligent EQ and filtering along with other advanced audio waveform manipulation techniques. Although tracks cannot be separated completely from the mastered waveform song they can be reduced or isolated to a 'somewhat usable level.' Such processes are normally very difficult and require the user to have a high level of skill and knowledge in choosing the correct settings etc to achieve the isolation of one track in the audio or the removal of one track in the audio. Due to the retrofit nature of the retrofile format however, all these settings can be pre-programmed before the fact such that a user can simply select mute or solo for a particular track in the particular waveform song and the pre-programmed audio manipulation techniques established during retrofitting to achieve the desired result can be put into effect. All that is required is the required level of functionality in the playback unit. In this fashion a user can mute the bass-line of a particular waveform song (to some degree) and replace it with the MIDI version of the original bass-line that they can manipulate, an alternate bass-line they can manipulate or play ad-lib on an iGruuv keyboard in replacement of the bass-line. As track splitting soft ware/hardware becomes more sophisticated future retrofiles/retroplayers can take advantage of this functionality to a greater degree.

6: File Format 2.

If the retrofile format 'catches on' and original musicians start providing alternative MIDI and/or waveform and synthesis tracks to their prior or current compositions and users start to mix and share their own compilations it may be possible to implement an 'enhanced version' of the retro file format. It is highlighted that this may only be possible if the retrofile format catches on, because in order to implement this enhanced retrofile format the various music studios (Sony etc) would need to agree to release the master trucks of original-waveform songs to the public, file format 2 would provide to the full extent that which the audio manipulation capabilities outlined in 5 above provide to some extent. As mentioned above, it. is true that audio manipulation technology can mute, solo and isolate tracks in songs (waveforms) to a limited extent, but in order to truly affect this functionality the different tracks of the original mastered waveform song must be provided as separate entities. Only then can a user truly mute or solo a track in the original waveform song, file format 2 is an extension of file format 1 whereby the original audio of the songs is provided in individual tracks allowing a user to mute, solo and apply filters, effects etc to the individual audio (waveform) tracks of the original song. In reference to the above ideas this means that a user could actually 'take over' the playback of a bass line or other track and that a collaborative effort could largely lake over the song with only a few original waveform track remnants remaining if so desired. This is jamming with your favorite band at the next level.

7: File Sharing.

Essentially when a user purchases a song in type 1 retrofile format they are purchasing two copyrighted items, the original mastered audio of a song and the musical score or MIDI of a song. This means that when a user uses the MIDI to rearrange the audio and adds to the composition by utilizing and manipulating the provided original MIDI, the provided alternative MIDI or their own MIDI creation they have used the mastered audio copyright and perhaps the MIDI copyright. A file in retromix formal however can be designed such that whether or not the user used the copyrighted waveform song and MIDI in the creation of the remix, the remix file contains no elements of the original waveform song or its corresponding MIDI. A retromix file can be designed such that a user is merely saving a sol of instructions for manipulation of the original waveform song and MIDI version thereof. I.e. the user is merely saving an instruction set for the use of a type 1 or type 2 retrofile. An retromix file would therefore contain neither copyrighted waveform data, nor copyrighted MIDI data. This means that remixed works saved by a single user or by a collaboration of users as a retromix remix file, can be shared with other users without breaching copyright in any way. Other users who download from the online user community (or otherwise obtain) the retromix file who legitimately own the type 1 retrofiles or type 2 retrofiles and corresponding waveform songs (or pieces of songs) used in the retromix re-composition (and hence owns the copyrighted waveform and MIDI data) can then play back (and further remix and after if so desired) the retromix remixes also without breaching copyright in any way.

The online user community/sales repository could be set up such that when an retroplayer is connected to the Internet sales repository and is requesting download of a particular retromix remix file, the retroplayer requesting the download is required to 'validate' that (he user has legitimate copies of the requisite waveform songs, MIDI files/retrofile data, type 1 or 2 retrofiles files (or pieces of said files) required to playback the particular retromix remix. If not, a user could be prompted as to whether they wish to purchase the full renditions required or perhaps only the pieces of said renditions required to play back the retromix remix file.

In any event, validation or not, an iGruuv user can only playback a particular retromix remix if they have copies of the requisite waveform songs, MIDI files/iGruuv data or type 1 or 2 retrofiles.

File sharing could also be done using a combination of will and (orient technology so files are shared amongst the network of iPhone's rather than via a central server. Every time you're near someone with part of a file who is also set to 'sharing' at the time you can get that part of the file off them.

8: Anti-Piracy Tool.

The retrofile format can be used as a tool for enhanced anti-piracy measures for the music industry for two reasons:

1. Due to the fact that a retro file is not simply waveform data but includes MIDI, retrofile and other waveform, synthesis, playback and metadata the file format can include more sophisticated anti-piracy measures. The more sophisticated a file format is the more sophisticated anti-piracy measures can be put in it.

2. The second and most important anti-piracy measure the retrofile format provides is that a user actually wants the additional data that is included with the waveform data of a song. If a song is a simple waveform with appended copyright protection measures, the waveform can always be stripped from the rest of the data because the waveform is all the user needs or wants. The other data (copyright protection data or DRM data) is completely unwanted by the user and can be discarded. With a retrofile however, the other data (being the MIDI, retrofile, synthesis, playback and metadata) is required by the user in order to be able to use the file with retrofile functionality. The fact that the other data is wanted by the user can be used to an advantage in terms of anti-piracy because if the copy protection means is embedded in something the user actually desires and does not want to remove from the file; a user is less likely to do so.

The invention claimed is:

1. A method of creating an audio file including:

receiving waveform data representing a musical rendition;

analysing the waveform data to determine transient positions in the waveform;

using the transient positions to determine bar markers representing bar start/end positions for the rendition;

synchronizing a MIDI time grid with the bar markers;

determining MIDI data including a musical score for the entire rendition;

synchronizing the MIDI data with the MIDI time grid; and, creating a file including the MIDI data in synchronization with the MIDI time grid, bar markers and waveform data.

2. A method according to claim 1 wherein the method includes defining part markers for designating rendition and track parts by identifying at least one of:

track parts;

catch phrases; and, track solos.

3. A method according to claim 1 wherein the method includes performing waveform analysis to determine transient positions.

4. A method according to claim 1 wherein the method includes manually correcting the bar start/end positions.

5. A method according to claim 1 wherein the method includes determining a time grid between bar start/end positions.

6. A method according to claim 1 wherein the method includes:

determining an average tempo of the rendition; and, storing the average tempo as part of the file.

7. A method according to claim 1 wherein the part markers are MIDI data.

8. A method according to claim 1 further including defining additional parts, verses or tracks.

9. A method of creating a timing file for audio processes including:

receiving waveform data representing a musical rendition;

analysing the waveform data to determine transient positions in the waveform;

using the transient positions to determine bar markers representing bar start/end positions for the rendition;

determining MIDI data including a musical score for the entire rendition;

synchronizing the MIDI data with the MIDI time grid; and, creating a file including the MIDI data in synchronization with the MIDI time grid, bar markers in a timing file separate from the waveform data.

10. A method according to claim 9 further including storing the waveform data in the file in synchronisation with the MIDI data, the MIDI time grid, bar markers.

11. A method according to claim 9 further including defining additional parts, verses or tracks.

12. An audio file created by the method of claim 9.

13. A method of providing timing files for audio users, including:

creating one or more timing files according to the method of claim 9; and, providing the timing files available for download on a website.

14. A method according to claim 13 further including:

for each timing file, providing the waveform data in a file separate from the timing file.

15. A method according to claim 13 further including creating and providing portions of one or more timing files to a user.

* * * * *